United States Patent [19]

Nordstrom

[11] 3,952,480

[45] Apr. 27, 1976

[54] PACKAGING APPARATUS

[75] Inventor: John E. Nordstrom, Two Rivers, Wis.

[73] Assignee: Hayssen Manufacturing Co., Sheboygan, Wis.

[22] Filed: Apr. 28, 1975

[21] Appl. No.: 572,094

[52] U.S. Cl. ..... 53/187; 53/63; 53/268; 53/373

[51] Int. Cl.[2] ..... B65B 5/02; B65B 43/30; B65B 47/06

[58] Field of Search ..... 53/183, 187, 384, 188, 53/63, 266, 268, 252, 256, 373, 371, 190

[56] References Cited

UNITED STATES PATENTS

| | | | |
|---|---|---|---|
| 2,877,609 | 3/1959 | Bodolay et al. | 53/187 X |
| 2,881,573 | 4/1959 | Hensgen | 53/373 X |
| 2,885,846 | 5/1959 | Harker | 53/183 X |
| 3,022,620 | 2/1962 | Gallet | 53/373 X |
| 3,359,703 | 12/1967 | Quaadgras | 53/187 X |
| 3,619,973 | 11/1971 | Bella | 53/183 X |
| 3,727,373 | 4/1973 | MacLeod | 53/183 |
| 3,731,454 | 5/1973 | Crabb | 53/190 X |
| R28,350 | 3/1975 | Lerner | 53/187 X |

*Primary Examiner*—Travis S. McGehee
*Assistant Examiner*—Horace M. Culver
*Attorney, Agent, or Firm*—Koenig, Senniger, Powers and Leavitt

[57] ABSTRACT

Apparatus for packaging items in plastic bags, wherein plastic bags are formed with seams at both sides, but open at the corners at the bag mouth, whereby each wall of the bag has a flap at its mouth end, each bag being fed forward sidewise to a loading station where the flaps are clamped and separated to open the bag and the item to be packaged is pushed into the bag, after which the bag mouth is spread for being sealed, and then sealed.

24 Claims, 39 Drawing Figures

FIG. 18
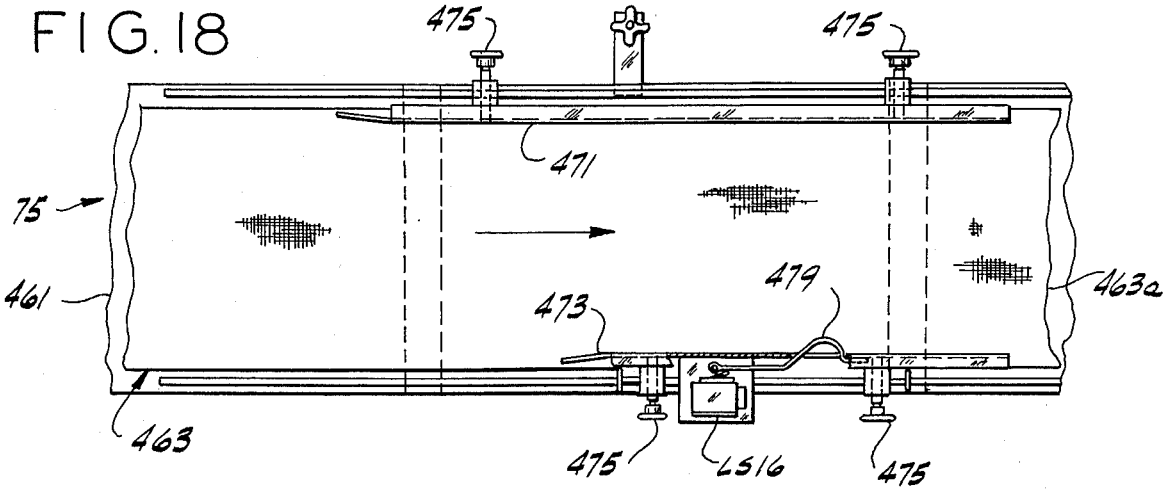
FIG. 19
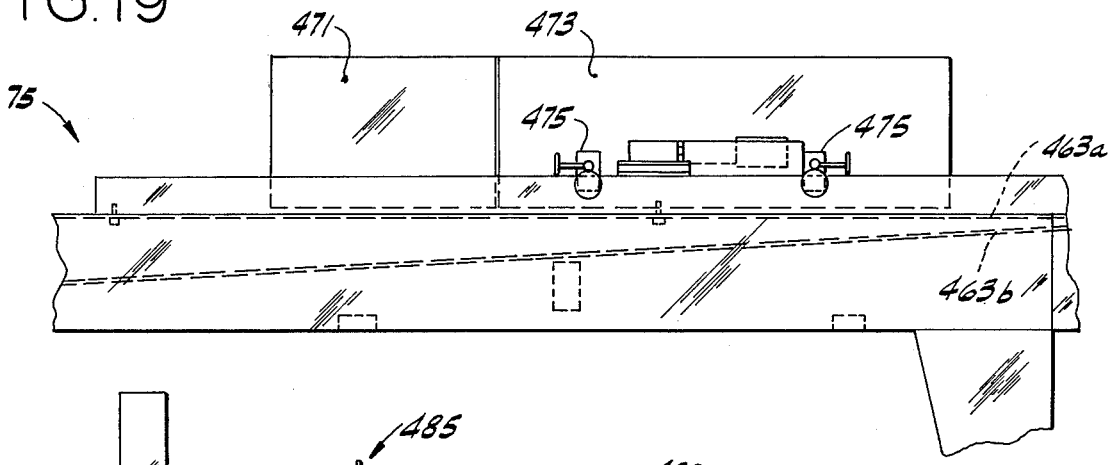
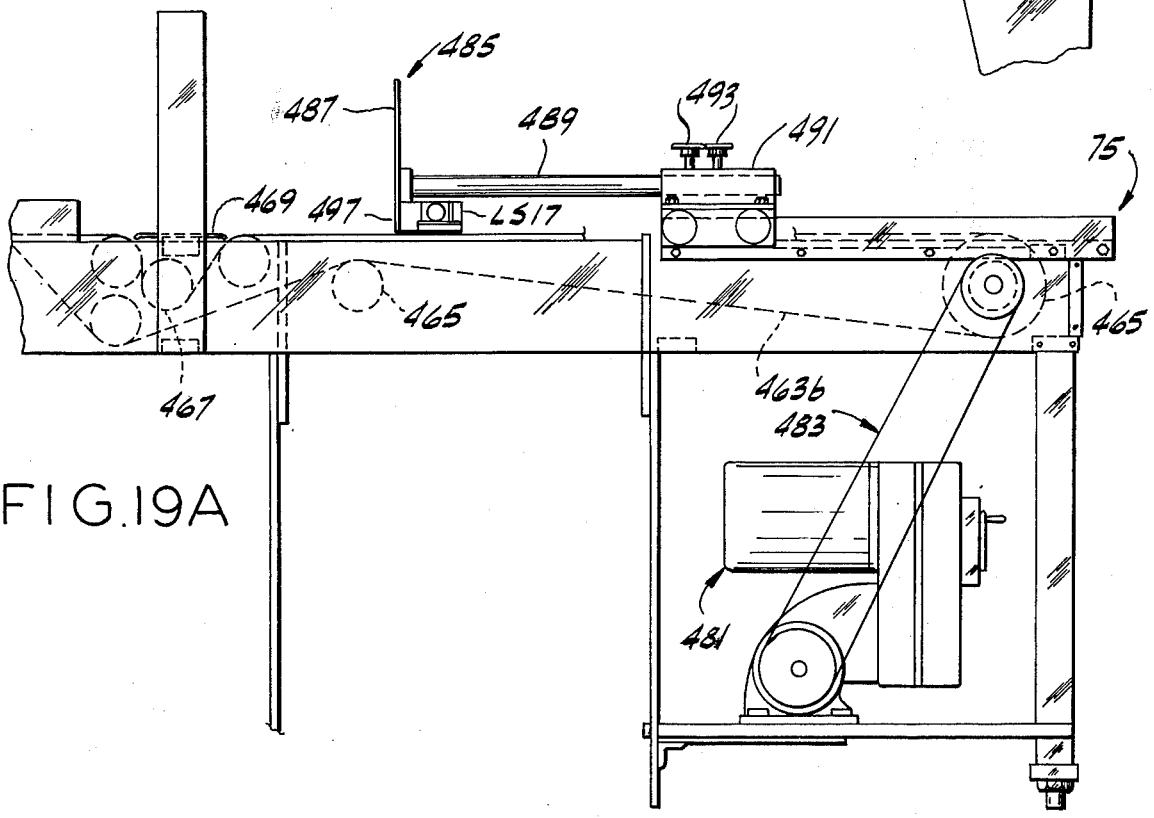
FIG. 19A 333
135
385
141b
141a
139b
139a
339
361
353
357
343
351
355
335b
335a
345
347
349
365
367
369
341
387
133

PACKAGING APPARATUS

BACKGROUND OF THE INVENTION

This invention relates to packaging apparatus, and more particularly to apparatus for packaging items, such as disposable diapers, in plastic bags.

The invention especially involves apparatus in which items are packed in plastic bags by spreading open the mouth of a bag and pushing a unit to be packaged into the bag through the open mouth, after which the bag is sealed.

The apparatus is constructed to pack plastic bags which have open corners at their mouth end, each wall of the bag thereby having a flap at its mouth end to facilitate opening of the mouth. Reference may be made to U.S. Pat. Nos. 2,754,644 and 2,899,786, known to applicant as showing apparatus for packing such bags, but in which the bags are filled with fluent material via a filling spout, as distinguished from having a unit pushed into the bag.

SUMMARY OF THE INVENTION

Among the several objects of this invention may be noted the provision of apparatus for packaging articles to be packaged, such as unit quantities of disposable diapers, in plastic bags by opening a bag and pushing a unit into the bag, with the bag firmly gripped to enable a unit to be pushed into the bag; the provision of such apparatus in which bags are formed from a continuous supply of bag material and immediately delivered for being packed; the provision of such apparatus wherein the bag is neatly sealed at its mouth after it has been packed; and the provision of such apparatus adapted for forming, filling and sealing bags of different sizes.

In general, packaging apparatus of this invention comprises means for feeding bags sidewise to a loading station, each bag being an open mouth bag and each wall of the bag having a flap at its mouth end. The apparatus has a pair of clamps at the loading station for clamping the flaps, each clamp comprising a pair of jaws movable relatively to one another between an open position for sidewise entry of a flap therebetween and a closed position for clamping the flap. The clamps are mounted for movement relatively to one another between a flap-receiving position wherein the clamps are relatively close together and a bag-opening position wherein the clamps are spread apart. The clamps when in flap-receiving position with their jaws open are adapted for sidewise entry therein of the flaps of a bag as the bag is fed forward to the loading station. Means is provided for closing the jaws of each clamp for clamping the flaps, for moving the clamps relatively to one another with the flaps clamped therein to the bag-opening position for opening the bag, and means for loading the opened bag. Other objects and features of this invention will be in part apparent and in part pointed out hereinafter.

BRIEF DESCRIPTION OF THE DRAWINGS

FIG. 18 is a plan showing another part of the article infeed conveyor;

FIG. 19 is a view in elevation of the part of the article infeed conveyor shown in FIG. 18;

FIG. 19A is a view in elevation of another part of the article infeed conveyor;

Corresponding reference characters indicate corresponding parts throughout the several views of the drawings.

DESCRIPTION OF THE PREFERRED EMBODIMENT

Figure 1:
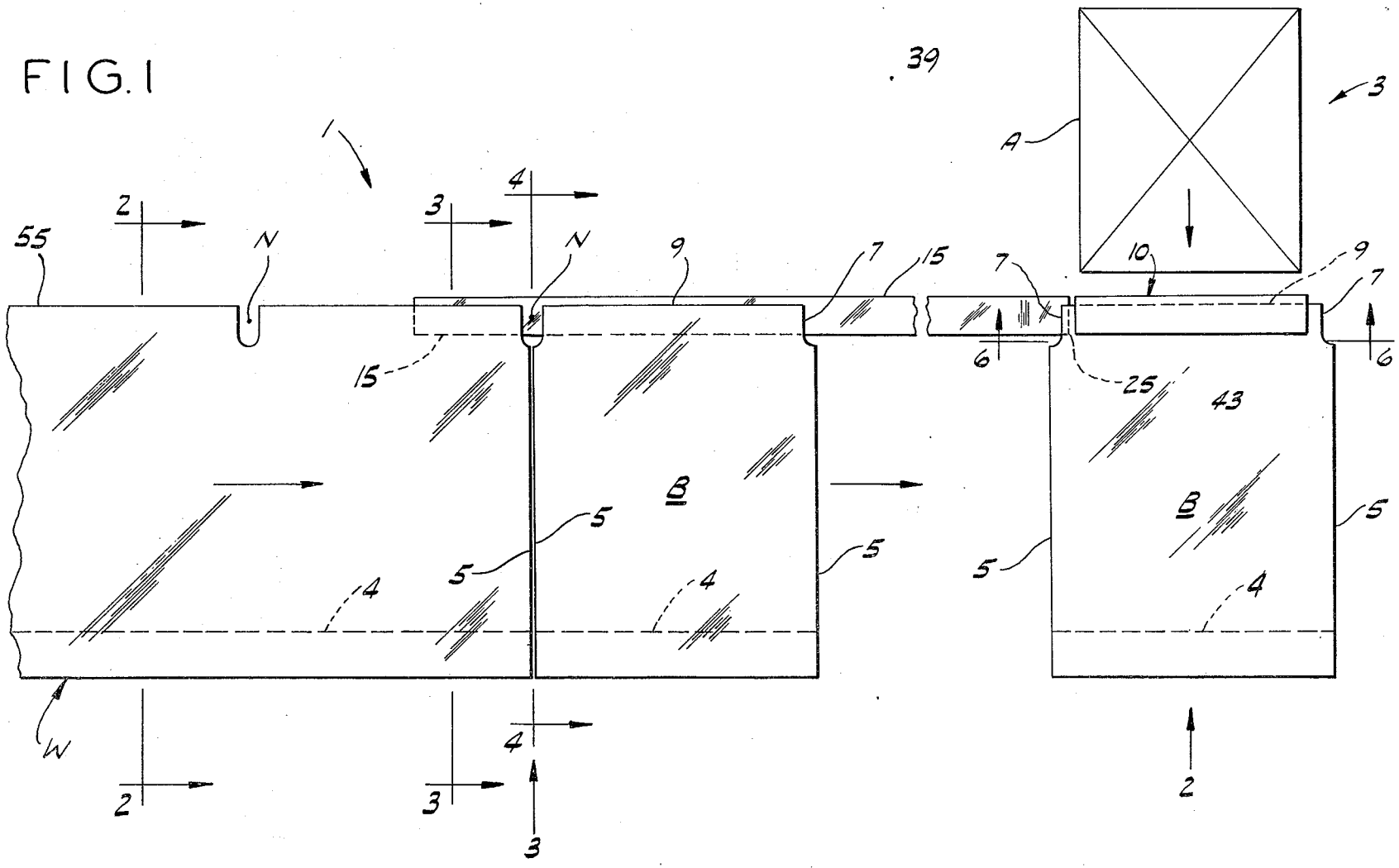
FIG. 1 is a diagrammatic plan view illustrating certain basic principles of the invention, including the formation of bags with flaps at the bag mouth.
Figure 2:
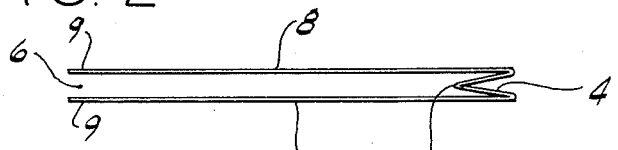
FIGS. 2–4 are sections on lines 2—2, 3—3 and 4—4 of FIG. 1, FIG. 4 showing a bag side sealing unit.
Figure 3:
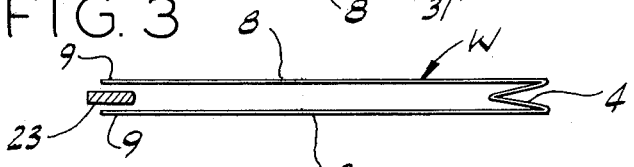
Figure 4:
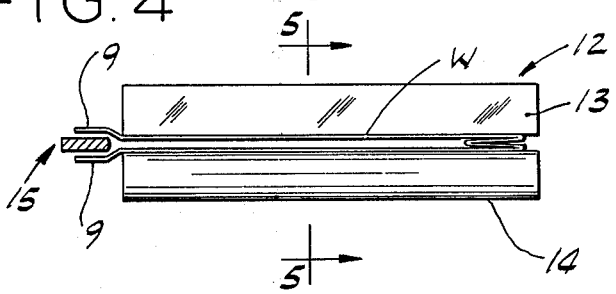
Figure 5:
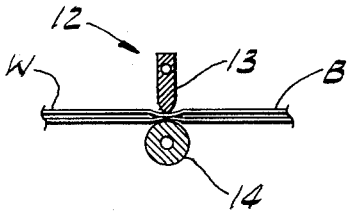
FIG. 5 is a section on line 5—5 of FIG. 4 showing the bag side sealing unit.
Figure 6:
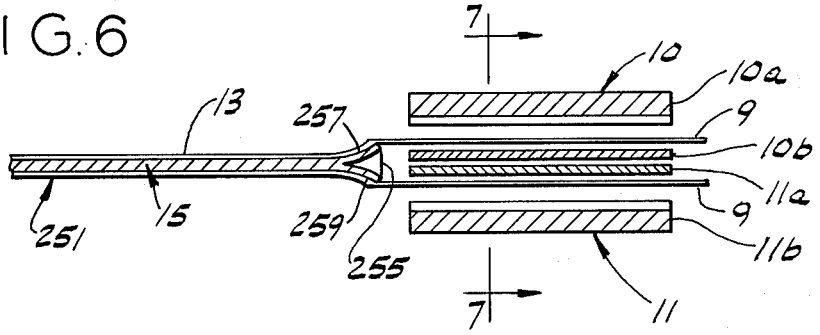
FIG. 6 is a section on line 6—6 of FIG. 1 showing certain clamps for clamping the flaps at the bag mouth, the clamps being shown open and in the position occupied for receiving the flaps.

First, for a general understanding of the apparatus of this invention, reference is made to FIGS. 1—8 diagrammatically illustrating the apparatus and its mode of operation. As therein shown, a bag B formed in a bag-forming section 1 of the apparatus is fed forward in the direction of the width of the bag to a loading station 2 in a bag filling and sealing section 3 of the apparatus, where the bags are filled and sealed. The bags are formed from a web W of heat-sealable plastic film, e.g., polyethylene film, with a bottom gusset 4, heat-sealed seams 5 at both sides, an open mouth 6 at one end, and open corners at the said mouth end as indicated at 7 whereby each of the two walls 8 of the bag has a flap 9 at its mouth end, these two flaps being free of one another all across the bag and at said corners.

The apparatus includes a pair of clamps 10 and 11 (see FIGS. 7 and 8) at the loading station 2, each clamp comprising a pair of jaws movable relatively to one another between open and closed positions, for clamping the flaps 9 of a bag.

The bag-forming section 1 includes a bag side seal unit 12 including a heated knife 13 and a backup roll 14 (see FIGS. 4 and 5 and also FIGS. 13, 14A and 14B) which are relatively movable toward and away from one another for heat-sealing and segmenting the web W on transverse lines spaced at bag width intervals. The web W, which is center-folded and formed with gusset 4 as appears in FIGS. 2—4 and 7, is intermittently fed forward (toward the right as viewed in FIG. 1) in bag width increments with a dwell between successive feed cycles, and is severed by the knife during each dwell, the knife (being heated) also functioning to heat seal the two walls 8 of the web together on opposite sides of the line of severance thereby to form the bag side seals 5. Each completed bag is fed forward to the loading station 2, and as it is fed forward the flaps 9 of the bag are spread apart for entry in the open clamps 10 and 11 by means indicated generally at 15. The bag stops at the loading station, the jaws of the clamps are closed to grip the flaps, and the clamps are then moved relatively to one another to open the mouth of the bag as illustrated in FIG. 8. With the bag thus opened at the loading station, an article or unit A which is to be packaged is pushed into the bag by a loader 16.

Figure 9:
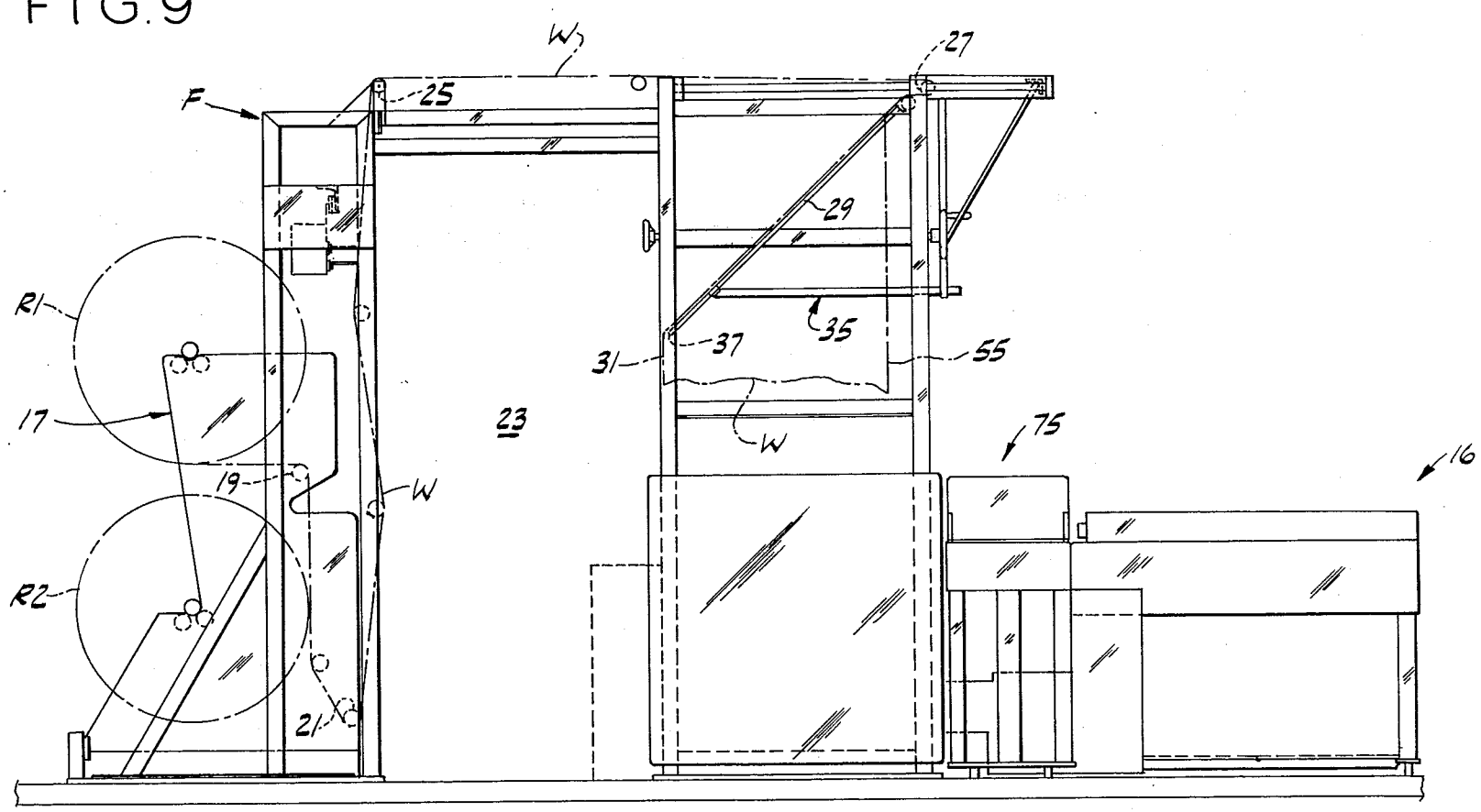
FIG. 9 is a rear end elevation of a complete apparatus of this invention.

More particularly, the apparatus comprises a frame generally designated F having means 17 for carrying a roll R1 of plastic film from which bags B are to be formed and a reserve roll R2. As delineated in FIG. 9, the film is unwound from the roll R1 (the "active" roll), fed around a guide roll 19 and down to a lower roll 21, around the latter and up on one side of a walkway 23 through the frame to a roll 25, around the latter and over the walkway to a roll 27, and around the latter and back to a triangular center-folding board 29. The film, in passing down over this board, is center-folded (i.e., folded in half on its longitudinal center line), the center fold being indicated at 31. It is drawn down over the board by a set of draw rollers 33. The board has the shape of a triangle, and is supported as indicated at 35 in the frame inclined at an angle of 45° to the horizontal with its hypotenuse horizontal and at the top, and its apex 37 down. The draw rollers 33 are mounted in the frame below and adjacent the apex of the board. From the draw rollers 33, the center-folded web travels rearward to an accumulator 39 constituted by a set of festooning rolls including upper rolls 41 mounted as indicated at 43 in fixed position in the frame F and lower rolls 45 carried by a pair of arms 47 pivoted at 49 in the frame for enabling continuous infeed of center-folded web by draw rollers 33 to the accumulator and intermittent withdrawal of center-folded web from the accumulator. As the center-folded web travels forward from the accumulator the gusset 4 is formed in suitable conventional manner at 50. Proceeding forward, the center-folded and gusseted web is guided by guide rolls such as indicated at 51 through a punch 53 for forming notches N (see FIG. 1) in the margin 55 of the center-folded gusseted web opposite the gusset, with these notches spaced at bag width intervals. Proceeding forward from the punch 53, the center-folded and notched web is guided by rolls such as indicated at 57 to the bag side seal unit 12, which has a pair of feed rolls 61*a* and b for intermittently feeding the center-folded web forward in bag width increments, with a dwell between successive feed cycles, and the knife and backup roll means 13, 14 operable during each dwell to sever the web on a line extending transversely of the web from the center fold side of the web to a notch N and to heat seal the two walls of the web together on opposite sides of the line of severance thereby to form the bag side seals 5.

Each bag B as completed by closure of the heated knife 13 and roll 14 to form the trailing side seal of said bag and the leading side seal of the next bag to be formed is fed forward away from the knife and roll by conveyor means indicated generally at 69 to the loading station 2 where the bag comes to a stop and dwells for the loading operation. The bag is fed forward sidewise (i.e., in the direction of the width of the bag) and in a horizontal plane to the loading station, coming to rest at the loading station in a horizontal position with its open mouth 6 at the right of the conveyor means as viewed in the direction of travel of the bag in position for having a unit A to be packaged in the bag pushed into the bag, after opening the mouth of the bag, by the loading means or loader 16. The unit A to be packaged in the bag, such as a stack of disposable diapers, is delivered to the loading station by means of an article delivery conveyor 75, which may be referred to as the product infeed conveyor, extending along the right side of the bag side seal unit 12 and the conveyor means 69. The loader 16 comprises pusher plates 77 and 79 and means indicated generally at 81 for operating these plates. They normally occupy a retracted position at the right of the product infeed conveyor 75 at the loading station 2, and are movable via means 81 away from their retracted position to push a unit A laterally off the conveyor 75 through a tapered guide or funnel 83 into the opened bag at the loading station, and then back to retracted position. Upon retraction of the pusher plates, conveyor means 69 functions to convey the loaded bag forward to a take-away conveyor 85.

Figure 24:
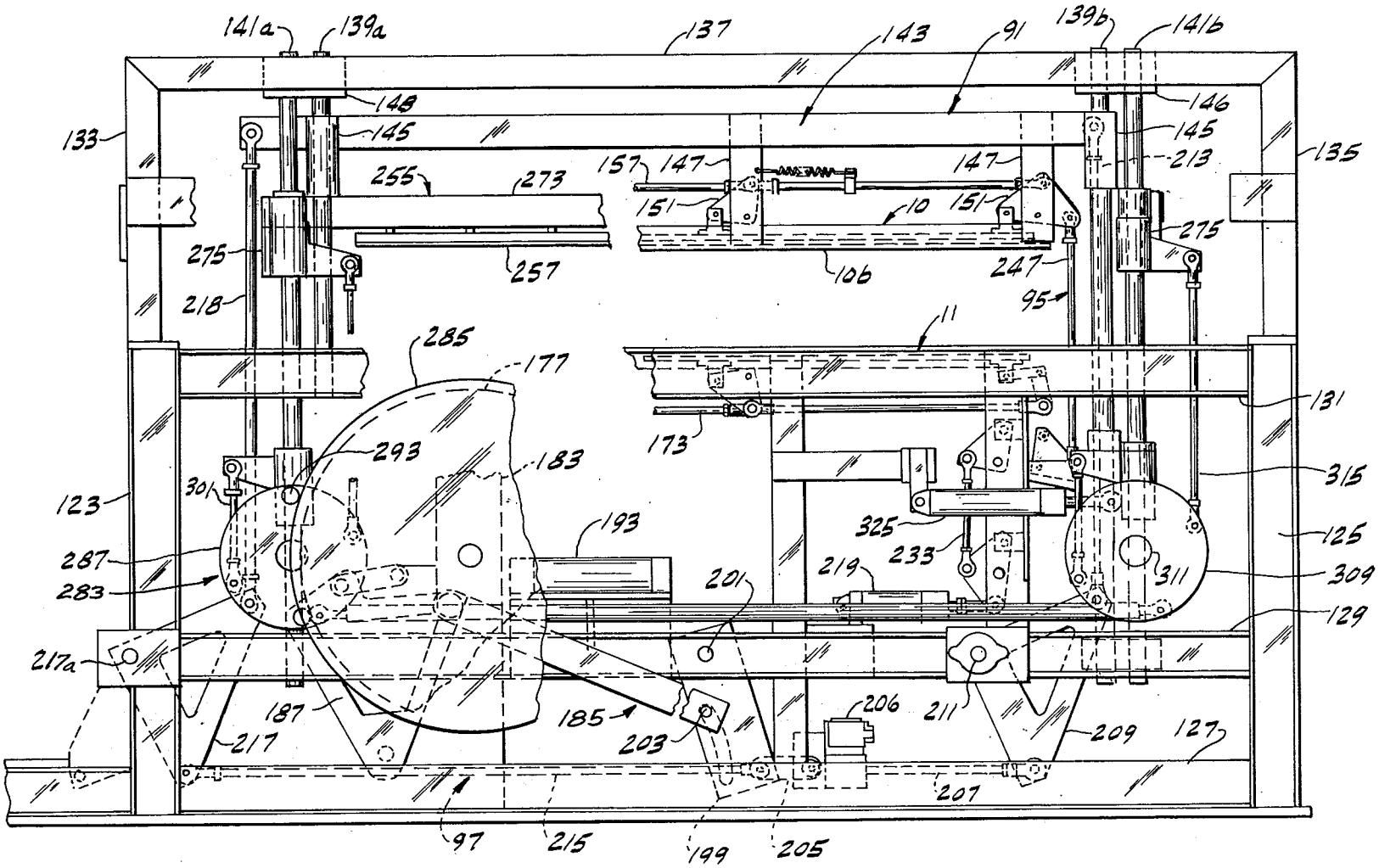
FIG. 24 is a view generally in vertical longitudinal section on line 24–24 of FIG. 11, with parts broken away, showing details of the clamp mechanism and the sealing mechanism of the apparatus, the clamps being shown in the right-hand part of the view and the sealing bars of the sealing mechanism being shown in the left-hand part of the view.
Figure 25:
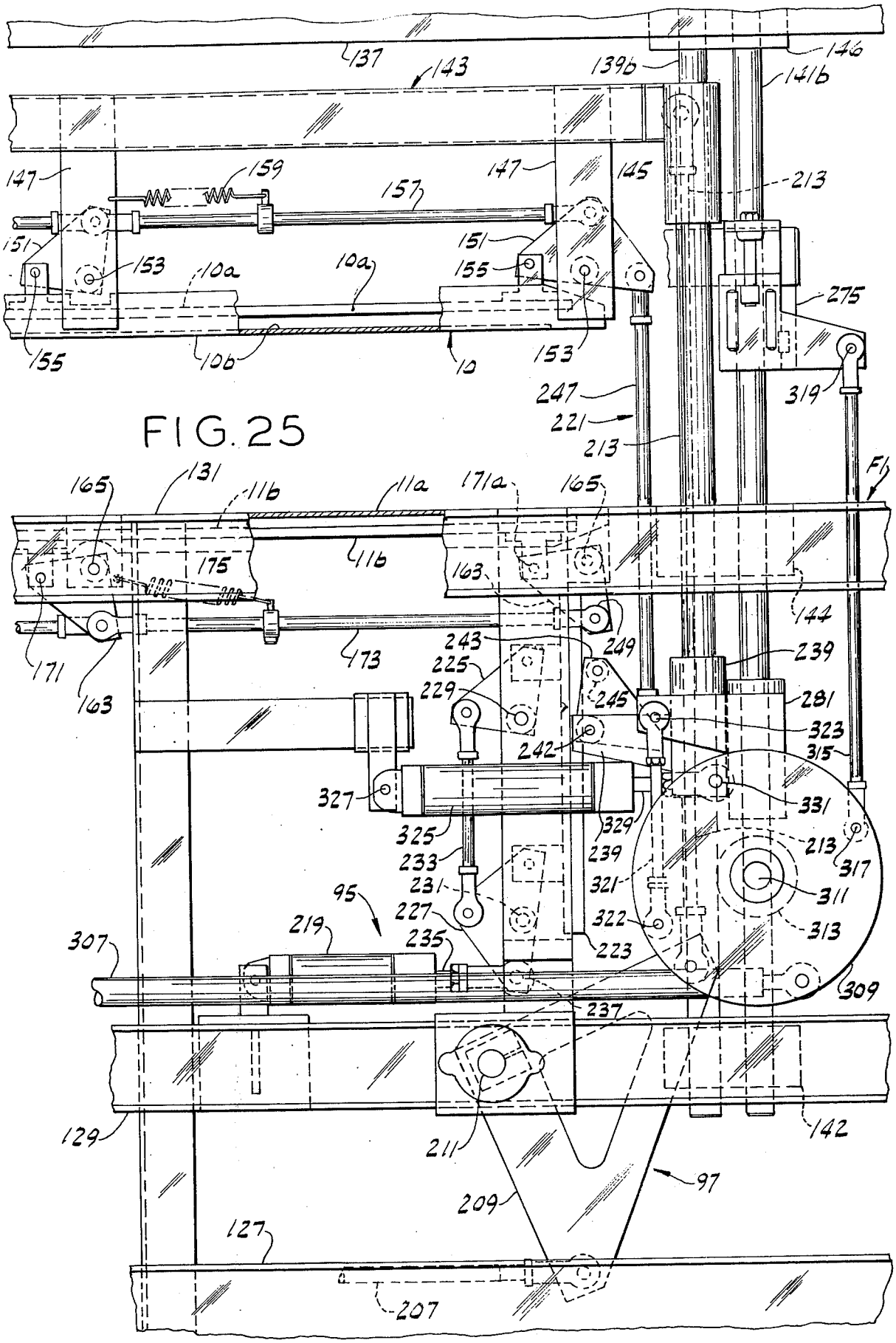
FIG. 25 is an enlargement of the right-hand part of FIG. 24, with parts broken away.

In accordance with this invention, the apparatus comprises a pair of clamps, namely the upper clamp 10 and the lower clamp 11 at the loading station 2 for clamping the mouth end flaps 9 of the bag B at the loading station (see FIGS. 6–8, 24, 25, 27 and 28). As previously pointed out, each clamp comprises a pair of jaws movable relative to one another between open and closed positions; thus the upper clamp 10 comprises an upper jaw 10*a* and a lower jaw 10*b* for clamping the upper flap 9 of the bag B at the loading station and the lower clamp 11 comprises an upper jaw 11*a* and a lower jaw 11*b* for clamping the lower flap 9 of the bag. Means indicated generally at 91 is provided mounting said clamps for movement relative to one another between the flap-receiving position of FIGS. 6, 7 and 27 wherein the clamps are relatively close together (with clamp 10 immediately above clamp 11) for entry of the upper flap 9 between the open jaws 10*a* and 10*b* of the upper clamp 10 and for entry of the lower flap 9 between the open jaws 11*a* and 11*b* of the lower clamp 11 and the open position of FIGS. 8, 24 and 28 for opening the mouth of the bag. The means indicated generally at 15 is provided for separating the flaps 9 of a bag B as the bag is fed forward from the bag side sealer unit 12 for the entry of the flaps between the jaws of the respective clamps i.e., entry of the upper flap 9 sidewise between the open jaws 10*a* and 10*b* of the upper clamp 10 and the lower flap 9 sidewise between the open jaws 11*a* and 11*b* of the lower clamp 11. Means indicated generally at 95 in FIGS. 24 and 25 is provided for opening and closing the jaws of each clamp, and means indicated generally at 97 in FIGS. 24 and 25 is provided for moving the clamps, with their jaws closed and gripping the flaps, to their open position of FIGS. 8 and 28 for opening the bag. And, as previously noted, means 16 is provided for loading the opened bag.

Figure 10:
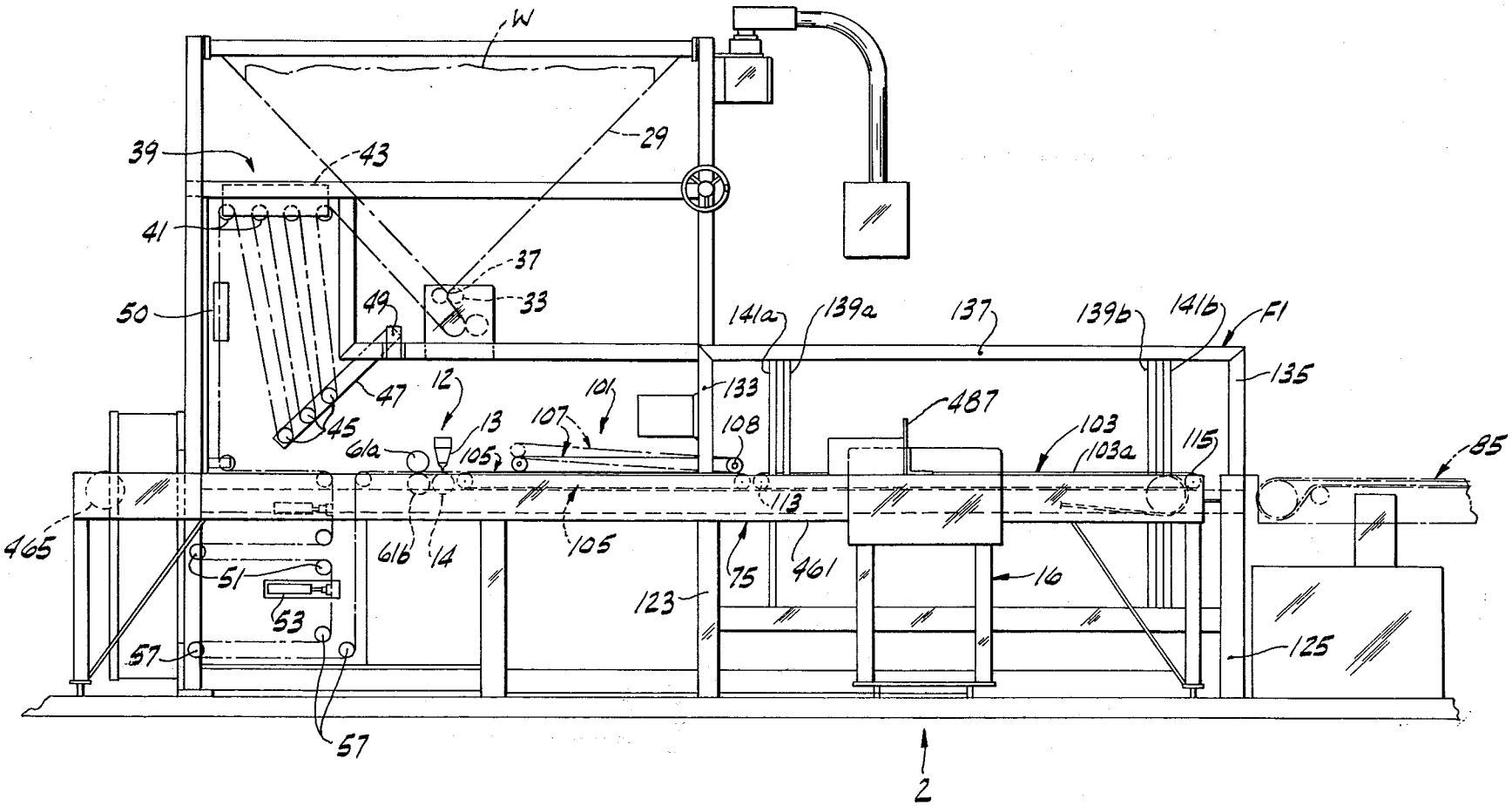
FIG. 10 is a side elevation of the apparatus.
Figure 11:
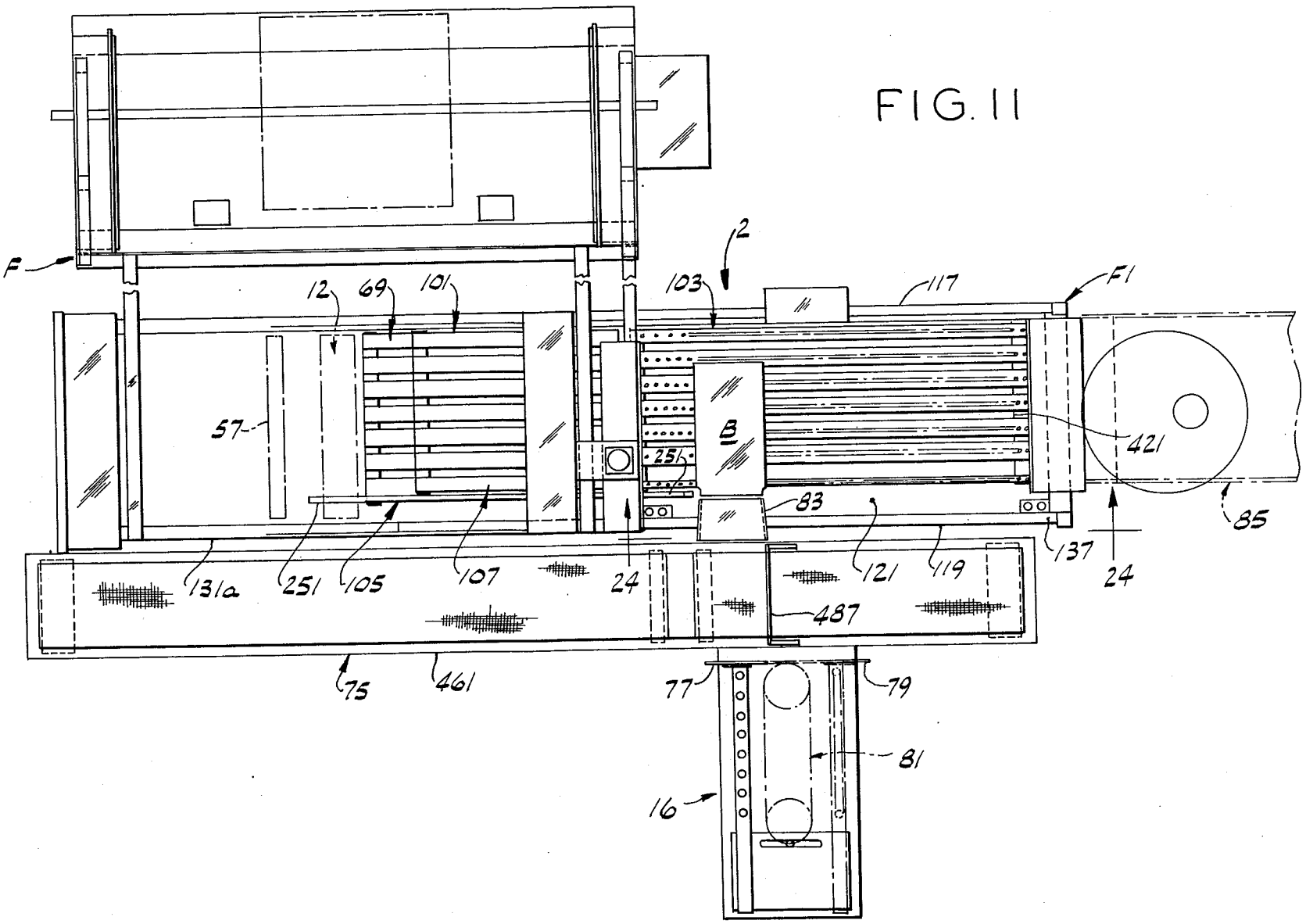
FIG. 11 is a plan of the apparatus, with parts broken away.
Figure 12:
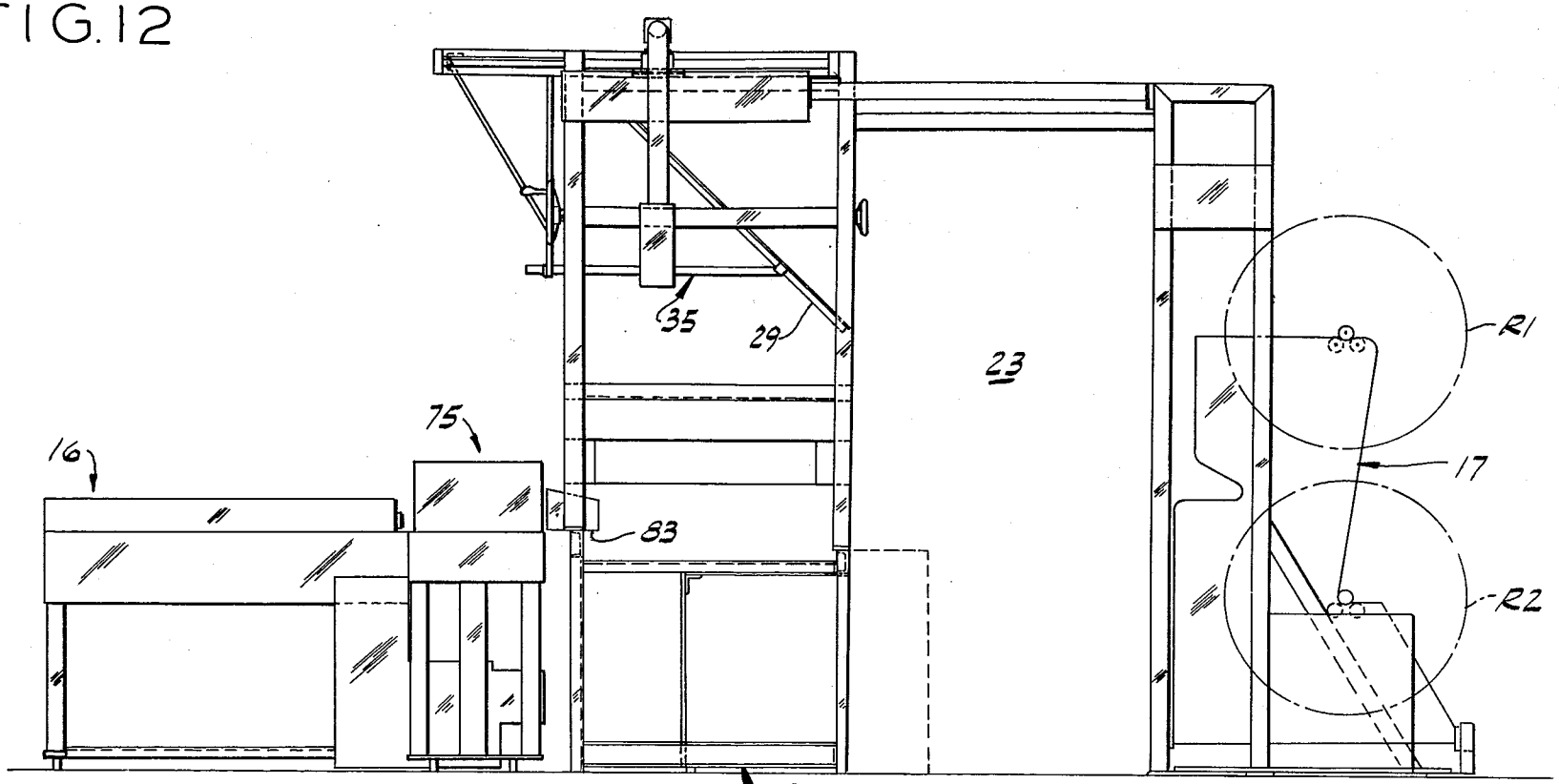
FIG. 12 is a forward end elevation of the apparatus (as viewed from the right end of FIG. 11)
Figure 15:
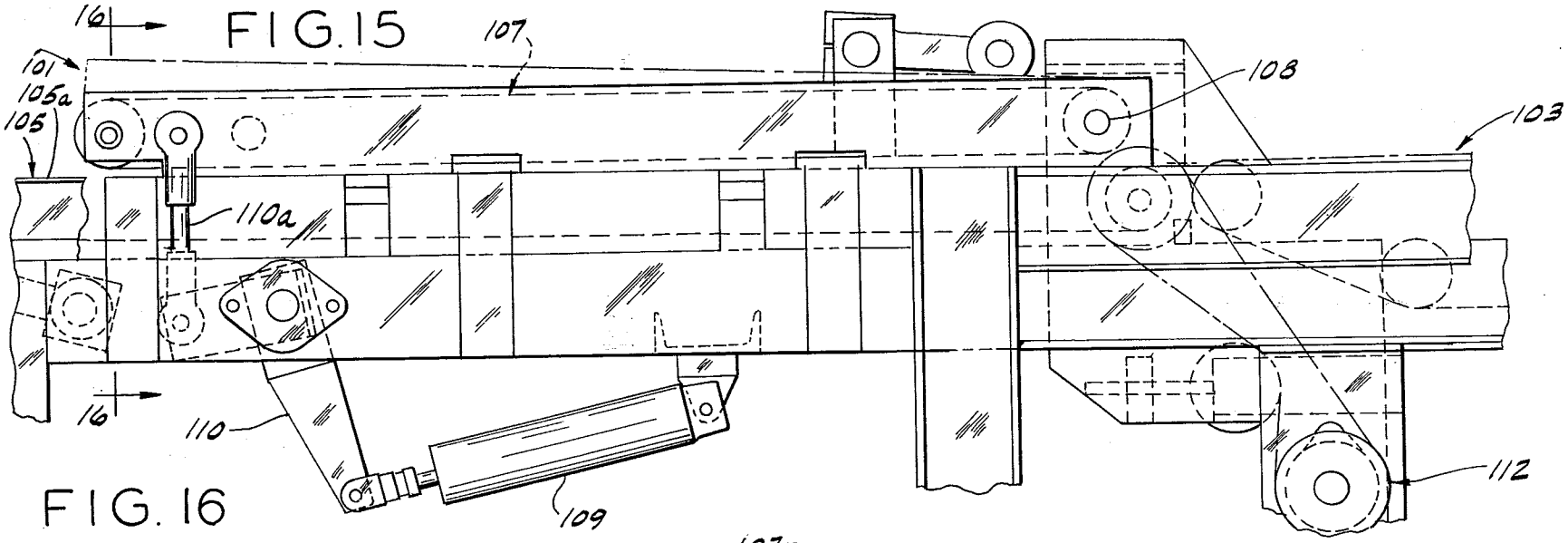
FIG. 15 is a view in side elevation of said first bag conveyor.
Figure 16:
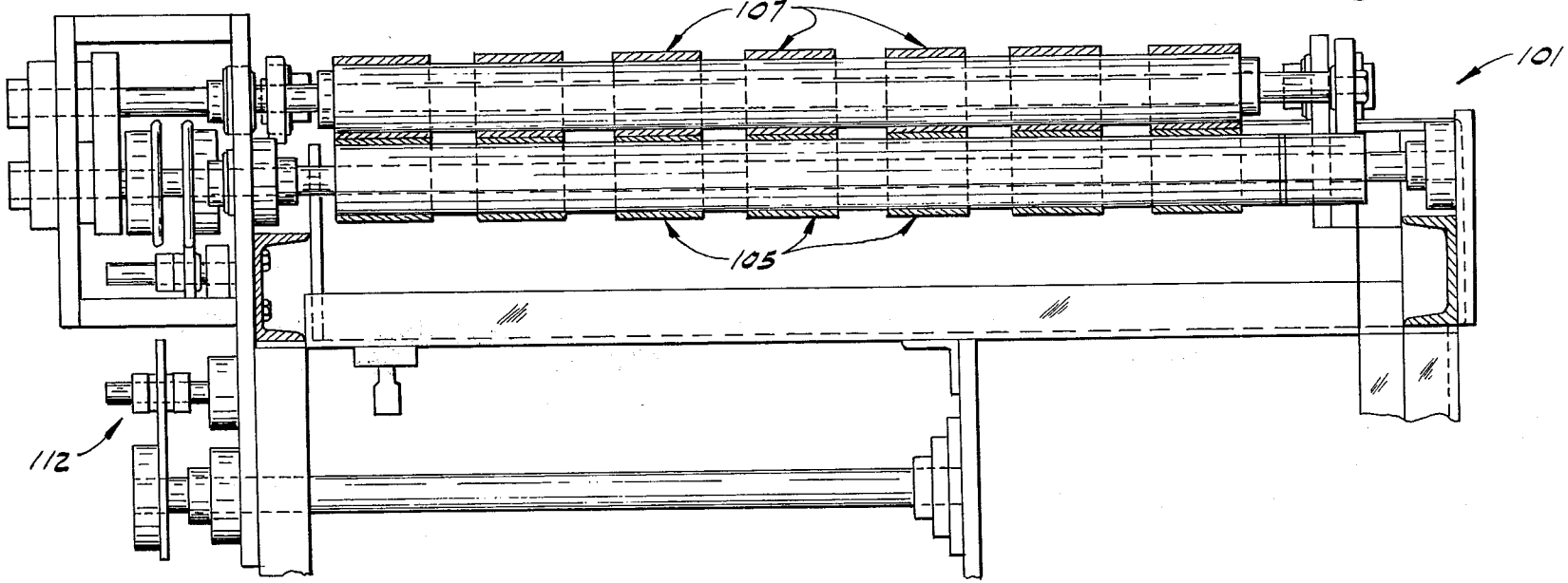
FIG. 16 is a vertical transverse section on line 16—16 of FIG. 15 showing details of the first bag conveyor.

The conveyor means 69 comprises first and second bag conveyors 101 and 103 in tandem, the first conveyor 101 being adapted to feed forward a completed bag B (when the bag is segmented from the web W by the heated knife 13) to the second, the second receiving the bag from the first and feeding it forward to the loading station 2, where the bag dwells for being loaded, and then, after the bag has been loaded, feeding it forward away from the loading station. The first conveyor 101 (see FIGS. 10, 11, 15 and 16) comprises a lower set of endless belts 105 having a horizontal upper reach 105*a* at the level of the pass plane of the intermittent feed rolls 61*a* and *b* of the bag side seal unit 12, and an upper set of endless belts 107 pivoted as indicated at 108 to swing between the raised retracted position shown in phantom in FIGS. 10 and 15 out of contact with a bag extending forward from the knife 13 and roll 14 and the lowered position shown in solid lines in FIGS. 10 and 15 wherein the lower reaches of belts 107 press a bag against the upper reaches 105*a* of belts 105 to feed the bag forward. As shown in FIG. 15, the set of belts 107 is swung up and down about its pivot 108 by means of an air cylinder 109 via a crank 110 and link 110*a*. The belts 105 and 107 are adapted to be continuously driven via a suitable drive such as indicated at 112 in FIG. 16. The second conveyor 103 (FIG. 17) comprises a set of endless belts 111 trained around rollers 113 and 115 at the entry and exit ends of a bag filling and sealing section subframe F1, this second conveyor 103 having a horizontal upper reach 103*a*. The subframe has left and right sides 117 and 119 (left and right as viewed in the direction of forward travel of the bags, which is left to right as viewed in FIG. 10). At 121 (see FIGS. 11 and 17) is indicated a relatively wide space between the right side of the subframe and the right side of conveyor 103, for the clamps 10 and 11, their operating means and other mechanism to be described. The bags B are delivered on to the upper reach 103*a* of the conveyor 103 with the mouth end of the bag, including flaps 9, in position projecting to the right from the right side of the upper reach 103*a* for being entered and clamped in the clamps 10 and 11.

As shown in FIGS. 10 and 24–26, the right side of the subframe comprises legs 123 and 125 at the ends thereof, lower, intermediate and upper rails 127, 129 and 131 (shown as channels) extending between these two legs, posts 133 and 135 extending up from the legs, and an overhead beam 137 (shown as of box section) extending between the upper ends of these posts above the upper rail 131. The latter is a continuation of a rail 131*a* of the side sealing unit 12, its top surface being just slightly below the level of the pass plane of the intermittent feed rolls 61, the plane of the upper surfaces of the upper reach 105*a* of the lower set of endless belts 105 of the first conveyor 101 and the plane of the upper surface of the upper reach 103*a* of the endless belts 111 of the second conveyor 103.

A pair of vertical slide guide rods 139*a* and 141*a* are mounted in brackets 142, 144 and 146 on the inside of rails 129 and 131 and beam 137 adjacent the entry end of the subframe F1, and a similar pair of vertical slide guide rods 139*b* and 141*b* are mounted in similar brackets on the inside of these rails and the beam adjacent the exit end of the subframe. A carriage 143 is vertically slidable on the rods 139*a* and 139*b*, this carriage carrying the upper and lower jaws 10*a* and 10*b* of the upper clamp 10. Carriage 143 comprises a bar having guides 145 at its ends slidable on the rods 139*a* and 139*b*, and further having legs 147 extending down from the bar carrying the lower jaw 10*b* of the upper clamp 10 at their lower ends. The lower jaw 10*b* of the upper clamp 10 comprises an angle bar having one leg 10*c* secured in vertical position on the inside of the carriage legs 147 and its other leg extending horizontally inward at the lower edge of leg 10*c* and forming the lower jaw 10*b* proper. The upper jaw 10*a* of the upper clamp 10 comprises a bar extending above the lower jaw 10*b* (the horizontal leg of the angle bar 10*b*, *c*) having a resilient (e.g., rubber) presser strip 149 on the bottom for resiliently pressing the upper flap of a bag against the lower jaw 10*b* when the upper jaw 10*a* is closed by moving it down toward the lower jaw 10*b* so as firmly to grip the flap. Means mounting the upper jaw 10*a* for movement toward and away from the lower jaw 10*b* is shown to comprise a series of rockers 151 pivoted as indicated at 153 on the carriage legs 147, the upper jaw being pinned at 155 to these rockers, which are interconnected by connecting rod means as indicated at 157. The jaw 10*a* is biased to move down toward the lower jaw 10*b* by a spring 159 interconnected between one of the carriage legs 147 and the connecting rod means 157 tending to pull the rod means 157 to the left and rock the rockers counterclockwise as viewed in FIG. 25.

The upper jaw 11*a* of the lower clamp 11 comprises an angle bar having one leg 11*c* secured in vertical position on the brackets 145 and its other leg extending horizontally inward forming the upper jaw 11*a* proper. This angle bar 11*a*, 11*c* is secured to the brackets 144 with leg 11*a* extending inwardly at the upper edge of leg 11*c* coplanar with the jaws 10*a* and 10*b* of the upper clamp 10. The lower jaw 11*b* of the lower clamp 11 comprises a bar extending below the upper jaw 11*a* of the lower clamp (the horizontal leg of the angle bar 11*a*, *c*) having a resilient (e.g., rubber) presser strip 161 on the top for resiliently pressing the lower flap of a bag against the upper jaw 11*a* when the lower jaw 11*b* is closed by moving it up toward the upper jaw 11*a* so as firmly to grip this flap. Means mounting the lower jaw 11*b* for movement toward and away from the upper jaw 11*a* is shown to comprise a series of rockers 163 pivoted as indicated at 165 on supports such as indicated at 167 and 169, the jaw 11*b* being pinned to these rockers as indicated at 171. The rockers are interconnected by connecting rod means as indicated at 173. The jaw 11*b* is biased to move up toward the fixed jaw 11*a* by a spring 175 connected to the rod means 173 tending to pull this rod means to the left and rock the rockers 163 clockwise as viewed in FIG. 25.

Figure 7:
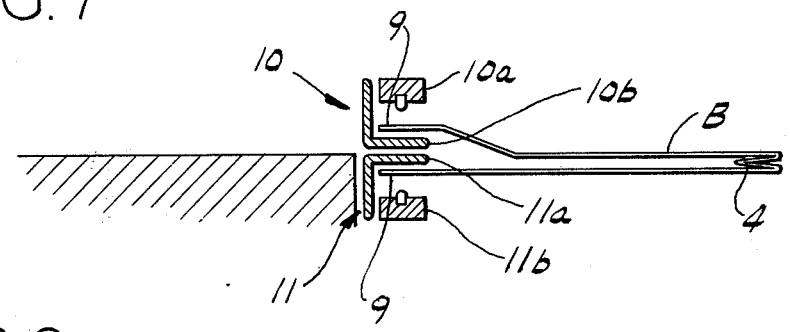
FIG. 7 is a section on line 7—7 of FIG. 6.
Figure 8:
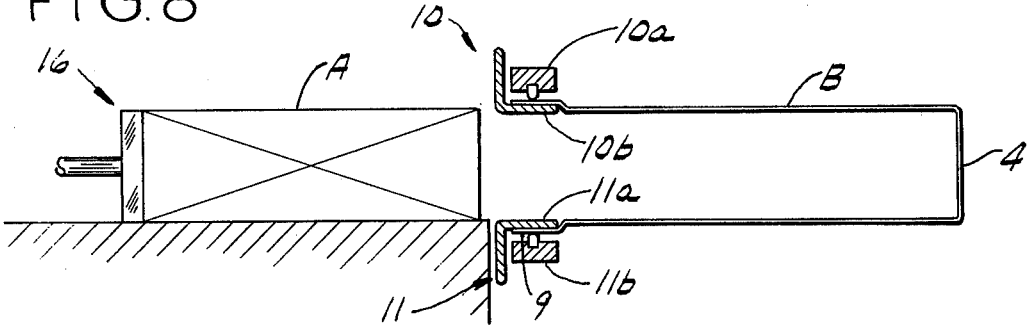
FIG. 8 is a view similar to FIG. 7 showing the clamps closed and spread apart to spread open the mouth of the bag, also showing product about to be pushed into the bag.
Figure 27:
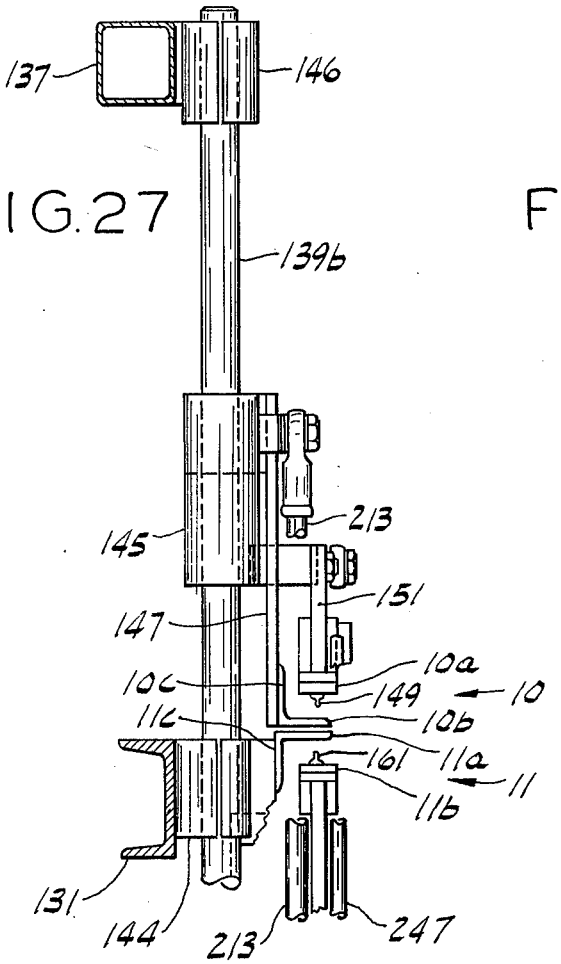
FIG. 27 is a vertical section showing the clamps and certain of the operating mechanism therefor, both clamps being shown open, and the upper clamp being shown in lowered position.
Figure 28:
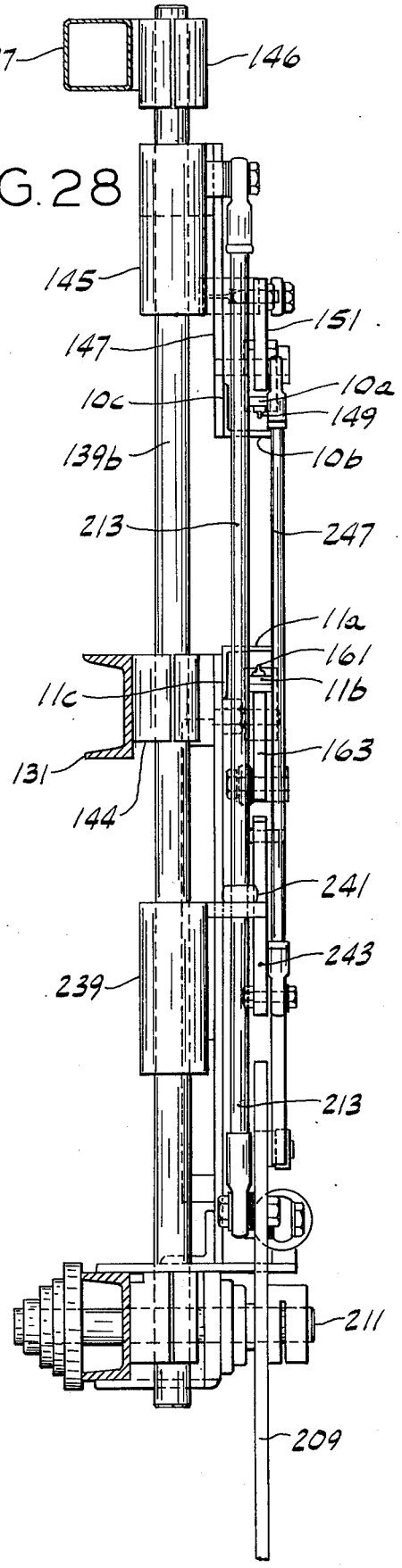
FIG. 28 is a view similar to FIG. 27 showing the upper clamp raised.
Figure 29:
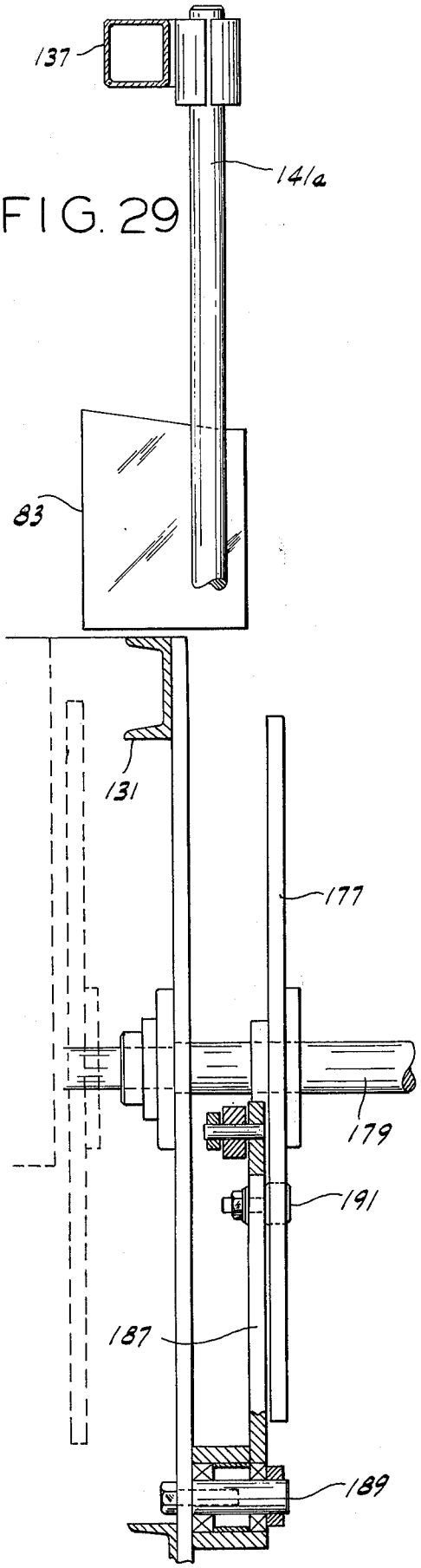
FIG. 29 is a view partly in section on line 29—29 of FIG. 26, omitting certain parts, and showing a bag spreader cam.

The carriage 143 is an element of the means 97 for effecting the relative movement of the upper and lower clamps 10 and 11 between their flap-receiving position of FIGS. 7 and 27 and their spread-apart position of FIGS. 8 and 28. The lower clamp 11 is stationary, the relative movement being effected by moving the carriage up and down to move the upper clamp 10 up and away from and down toward the lower clamp. Means 97 further comprises an edge cam 177, which may be referred to as the bag opener cam, mounted on a camshaft 179 journalled in bearings 181 in supports 183 in the subframe F1, and a drive 185 from the cam to the carriage 143. Drive 185 comprises a cam follower lever 187 pivoted at 189 on the rail 127 adjacent the entry end of the subframe F1 carrying a cam follower roller 191 engageable with the periphery of the cam 177, and adapted to be maintained in engagement with the periphery of the cam by means of an air cylinder 193 having its piston rod 195 connected to the cam follower lever 187 as indicated at 197. Lever 187 is adjustably connected by a link 198 to a crank 199 pivoted at 201 on the rail 129, the adjustment being via connection of the link at 203 in an arcuate slot in the crank, so that the throw of the crank may be varied for varying the rise of the carriage 143. Crank 199 is connected via a link 205, an overload coupling 206 and a connecting rod 207 to a rocker 209 pivoted at 211 on the rail 129 adjacent the right end of the subframe F1 (as viewed in FIG. 25). A rod 213 is interconnected between rocker 209 and the right end of the carriage 143. Crank 199 is connected via a connecting rod 215 to a rocker 217 pivoted at 217*a* adjacent the left end of the subframe F1, and a rod 218 is interconnected between rocker 217 and the left end of the carriage.

The means 95 for opening and closing the jaws of the upper and lower clamps 10 and 11 comprises an air cylinder 219, which may be referred to as the clamp jaw cylinder, and means 221 interconnecting the cylinder and the movable upper jaw 10*a* of the upper clamp 10 and the movable lower jaw 11*b* of the lower clamp 11, this means accommodating the raising and lowering of the upper jaw. It includes a vertical bar 223 constituting part of a parallelogram linkage operable by the air cylinder, this linkage including an upper and lower rocker 225 and 227 pivoted on the subframe F1 at 229 and 231 and interconnected by a vertical link 233 parallel to the bar. The piston rod 235 of the cylinder 219 is connected to the lower rocker 227 at 237, the arrangement being such that when the piston rod is extended, bar 223 is moved to the left as viewed in FIG. 25, and when the piston rod is retracted, bar 223 is moved to the right. A slide 239 is movable up and down on rod 139*b* in unison with the carriage via a connection 241 with the rod 213. Pivoted at 242 on this slide is a rocker 243 carrying a roller 245 engaging the bar 223 under the bias of spring 159 for the movable jaw 10*a* of the upper clamp 10. A rod 247 interconnects the rocker 243 and the rocker 151 at the right end of the carriage. The arrangement is such that, as the carriage moves up and down, the rocker 243 moves up and down in unison with it, roller 245 rolling on the right-hand face of the bar 223; when the bar 223 is moved to the left by extending piston rod 235 of cylinder 219, the rocker 243 rocks counterclockwise on pivot 242 as viewed in FIG. 25 to push the rod 247 up to close the jaw 10*a* of the upper clamp 10 (i.e., to move jaw 10*a* down); and when the bar 223 is moved to the right by retracting piston rod 235, the rocker 243 rocks clockwise to pull the rod 247 down to open the jaw 10*a* (against the closing bias of spring 159). The rocker 171*a* at the right end of the lower clamp 11 has a roller 249 engaging the bar 223 under the bias of spring 175 for the movable jaw 11*b* of the lower clamp 11. The arrangement is such that when the bar 223 is moved to the left by extending piston rod 235, the rocker 171*a* swings clockwise and the jaw 11*b* closes (moves up) under the bias of spring 175, and when the bar 223 is moved to the right by retracting the piston rod 235, the rocker 171*a* is swung counterclockwise to open the jaw 11*b* (against the closing bias of spring 175).

As a bag B is fed forward to the loading station 2, the upper clamp 10 is down in its lowered position and jaws 10*a* and 10*b* and 11*a* and 11*b* of the upper and lower clamps 10 and 11 are open for the endwise entry of the upper flap 9 of the bag between jaws 10*a* and 10*b* of the upper clamp 10 and the endwise entry of the lower flap 9 of the bag between jaws 11*a* and 11*b* of the lower clamp 11. As previously mentioned, the upper and lower flaps 9 are spread apart for entry in the opened clamps 10 and 11 by means 15. This comprises an elongate narrow separator blade 251 which extends from a point rearward of the bag side seal knife 13 and roll 14 to a point just rearward of the rearward end of the lower clamp 11 in a horizontal plane just above the plane of the upper reach of the belt conveyor 103 at the right side (as viewed in forward direction) of this conveyor in the vertical plane of the clamps. The blade extends over the roll 14 clear of the right end of the knife 13. In threading the web W through the apparatus, the right-hand margin of the upper wall of the centerfolded web is trained to pass over the top of the blade 251 and the right-hand margin of the lower wall of the center-folded web is trained to pass under the blade. The knife 13 seals the walls of the centerfolded web W to the inner (left) ends of the notches N in the margins, these notches extending to the left past the left edge of the blade 251. Thus, the bags B are formed with the flaps 9 at their mouth end, with the upper flap 9 over the blade and the lower flap 9 under the blade, and the bags are fed forward to the clamps 10 and 11 at the loading station 2 with the upper flap 9 over and the lower flap 9 under the blade.

At its forward (downstream) end, the blade 251 is forked as indicated at 255 (see FIG. 6) so that its upper surface 257 is inclined upwardly and its lower surface 259 is inclined downwardly to direct the upper flap 9 of a bag into the opened upper clamp 10 and the lower flap 9 into the opened lower clamp 11. When the bag comes to a stop at the loading station 2 with the upper flap 9 in the upper clamp 10 and the lower flap 9 in the lower clamp 11, the clamps are closed to grip the flaps, and the upper clamp 10 is moved up to spread open the mouth of the bag. Loader 16 then functions to push a unit A to be packaged into the bag. The bag is longer than the unit being packaged to allow for sealing together of the walls of the bag across the bag from one side to the other below the open corners 7 of the bag, and means indicated in its entirety at 255 is provided for effecting this sealing of the bag.

Figure 26:
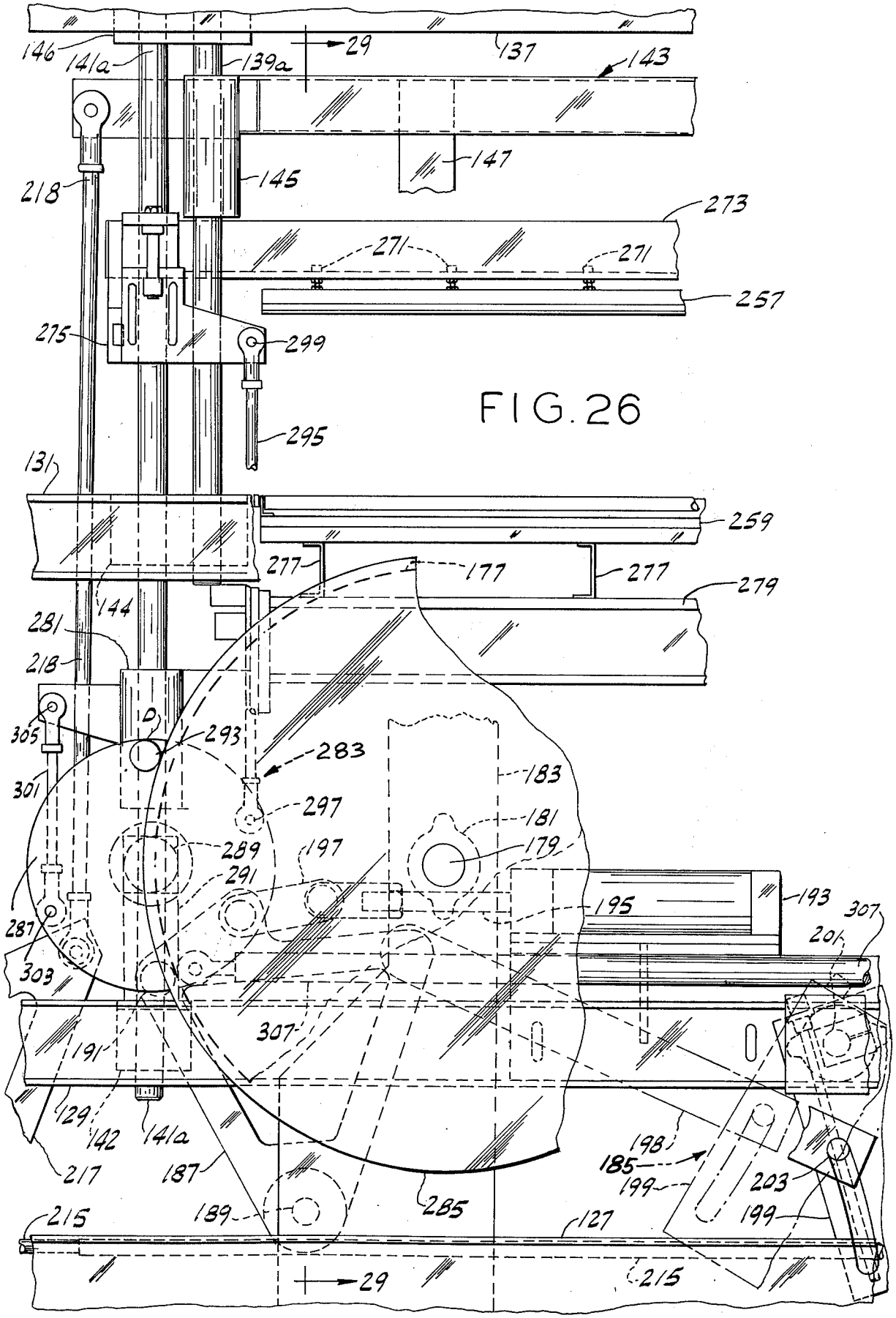
FIG. 26 is an enlargement of the left-hand part of FIG. 24, with parts broken away.
Figure 30:
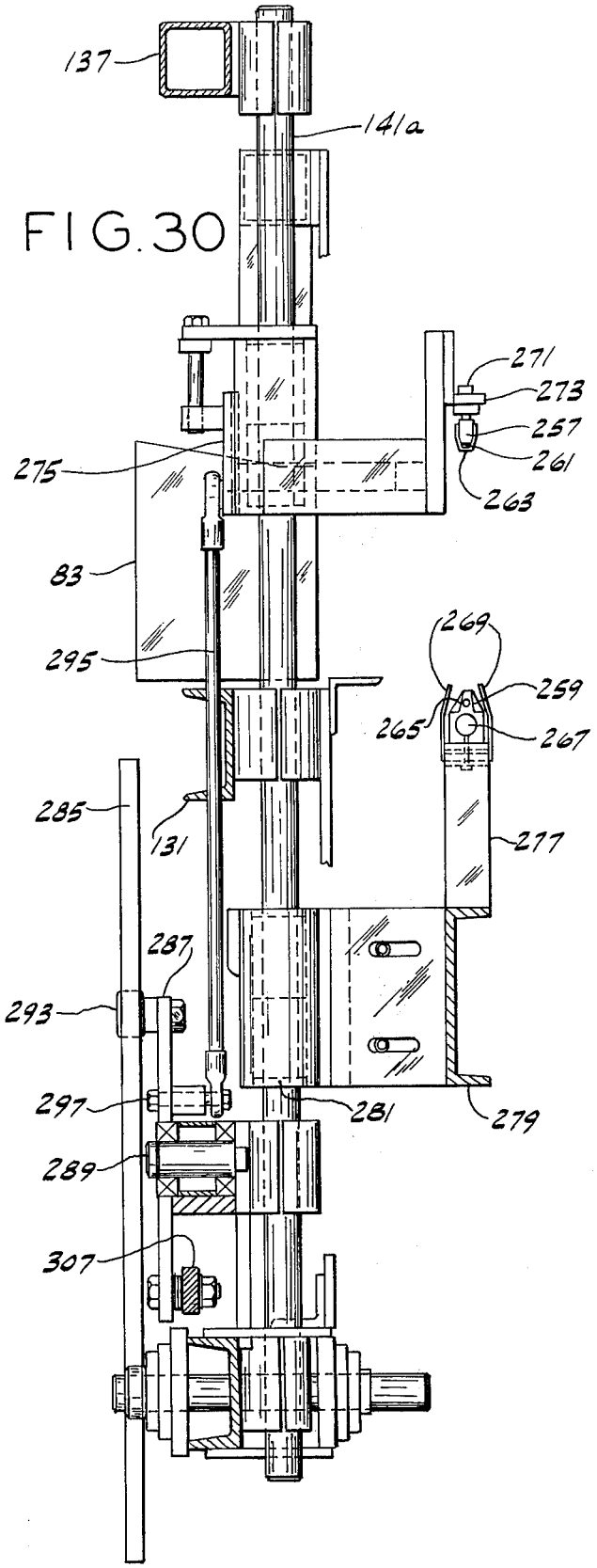
FIG. 30 is a vertical transverse section showing certain bag sealing bars, these bars being shown in their retracted position in solid lines and in their sealing position in phantom.

Referring to FIGS. 24, 26 and 30, the sealing means 255 is shown to comprise an upper seal bar 257 and a lower seal bar 259 adapted to close on the mouth of the bag (after it has been spread horizontally flat, as will appear) and to apply heat and pressure to the bag walls to heat-seal them together. The upper seal bar 257 is an aluminum bar, a silicon rubber pressure strip 261 extending along its bottom edge covered by "Teflon"impregnated fiberglass cloth as indicated at 263. The lower seal bar 259 is a split aluminum bar covered by similar cloth 265, having an electrical resistance heater 267 (e.g., a cartridge heater) incorporated therein, and further having heat shields as indicated at 269. The upper seal bar 257 is carried by bolts 271 on the bottom of an upper seal bar carriage 273 constituted by a bar having guides 275 at its ends vertically slidable on the rods 141*a* and 141*b*. The lower seal bar 259 is mounted on C-shaped supports 277 on a lower seal bar carriage 279 constituted by a bar having guides 281 at its ends vertically slidable on the rods 141*a* and 141*b*. The carriages 273 and 279 are oppositely movable up and down on the rods 141*a* and 141*b* to move the upper and lower seal bars 257 and 259 between an open position (enabling the spreading open of the bag by the clamps 10 and 11) and a closed position wherein the upper and lower seal bars are brought into pressure engagement with the bag walls for heat-sealing them together. The upper seal bar 257, in its open position, has its bottom located in a horizontal plane slightly above the horizontal plane of the lower jaw 10*b* of the upper clamp 10 when this clamp is in its raised position. The lower seal bar 259, in its open position, has its top located in a horizontal plane slightly below the horizontal plane of the upper jaw 11*a* of the lower clamp 11 (which is stationary). The upper seal bar 257 moves down from its open position and the lower seal bar 259 moves up from its open position and meet in a horizontal plane midway between these positions (and generally midway of the height of the funnel 83).

The upper and lower seal bar carriages 273 and 279 are adapted to be moved up and down to open and close the upper and lower seal bars 257 and 259 by means indicated generally at 283 including an edge cam 285, which may be referred to as the sealer cam, mounted on the camshaft 179 along with the bag opener cam 177, and a crank disk 287 mounted for rotation at 289 adjacent the entry end of the subframe F1 in a bearing 291 extending up from rail 129 and carrying a cam follower roller 293 engageable with the periphery of cam 285. A rod 295 is pin-connected to the disk at 297 and at 299 to the slide 275, and a rod 301 is pin-connected to the disk at 303 diametrically opposite pin connection 297 and pin-connected at 305 to the slide 281. A link 307 interconnects disk 287 and a similar disk 309 mounted for rotation at 311 adjacent the exit end of the subframe F1 in a bearing 313 extending up from the rail 129. A rod 315 is pin-connected at 317 to the disk 309 and at 319 to the right-hand slide 275, and a rod 321 is pin-connected at 322 to the disk 319 diametrically opposite pin connection 317 and pin-connected at 323 to the right-hand slide 281. An air cylinder 325, pinned at 327 to the subframe F1, has its piston rod 329 pin-connected to the disk 309 at 331 for biasing this disk and disk 287 to rotate clockwise as viewed in FIG. 24, which is in sealer closing direction, to maintain roller 293 in engagement with the periphery of cam 285.

Figures 31, 32:
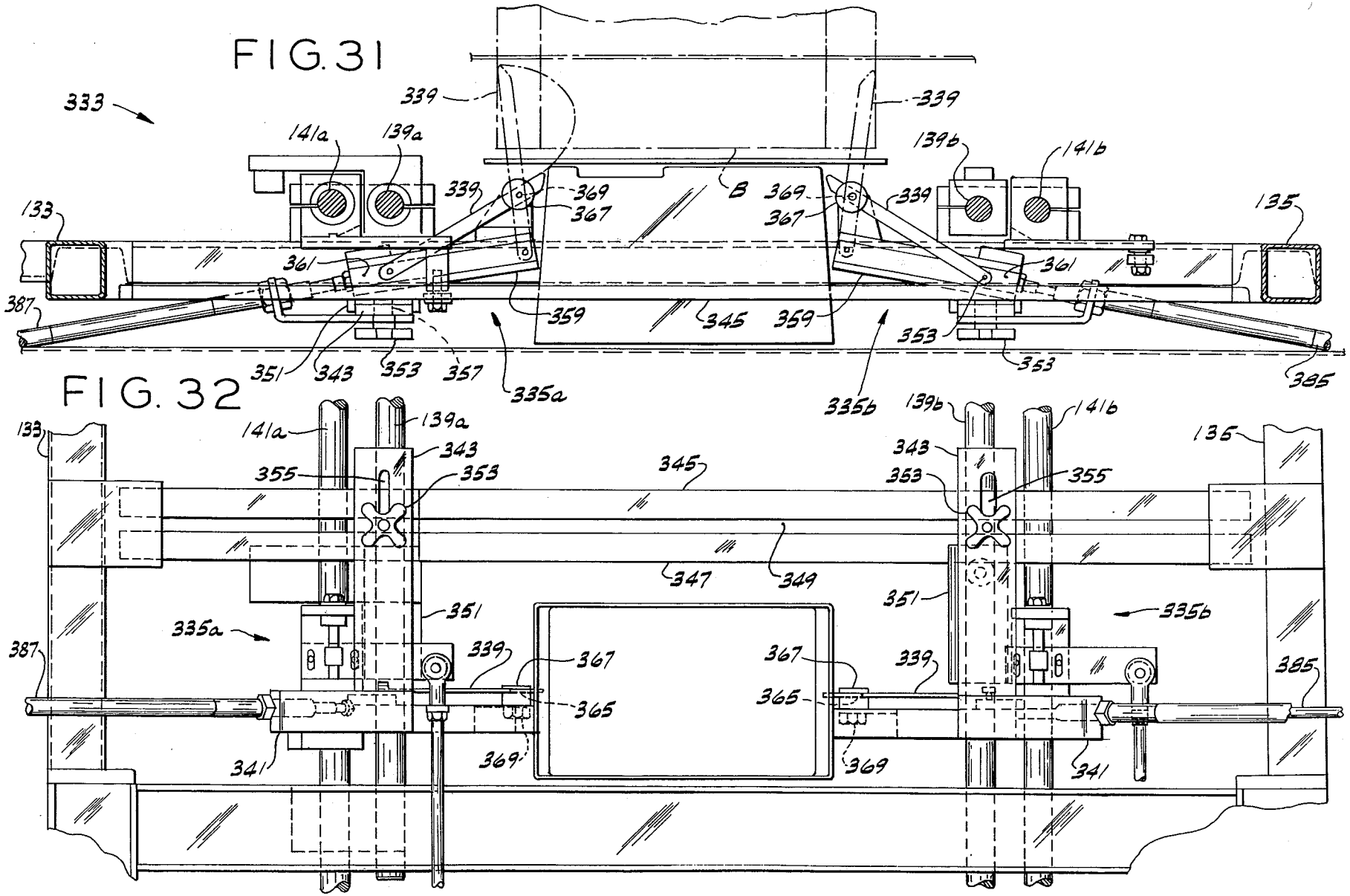
FIG. 31 is a view in plan of a bag spreading means of the apparatus, with parts broken away.
FIG. 32 is a view in front elevation of the FIG. 31 bag spreading means.

Referring to FIGS. 31 and 32, the sealing means 255 is shown further to comprise means indicated generally at 333 at the loading station for spreading open the mouth of the bag horizontally flat after it has been packed for the sealing of the mouth of the bag by the upper and lower seal bars 257 and 259. This spreading means comprises a left-hand spreader unit 335*a* and a right-hand spreader unit 335*b*, each comprising a spreading finger 339 adapted to enter the opened bag at the respective side thereof in the central horizontal plane of the opened bag and to move laterally outwardly to spread the bag flat at its mouth. Both of these units are vertically adjustable to locate their horizontal plane of operation in the central horizontal plane of opened bags of different opened mouth height. The left-hand unit and the right-hand unit are suitably adjustable longitudinally of the apparatus to accommodate bags of different opened mouth width. Each unit comprises a bracket 341 secured to the lower end of a supporting leg 343 extending down from a pair of rails 345 and 347 spanning the posts 133 and 135 of the subframe F1 intermediate the rail 131 and the box beam 137. Rails 345 and 347 are spaced to provide a slot 349 therebetween. The leg 343 is vertically slidable in a guide channel 341 adjustable longitudinally along the rails, the leg being retained in vertically adjusted position and the channel being retained in longitudinally adjusted position by means of a clamp screw 353 which extends through a vertical slot 355 in the leg, a hole at 357 in the guide channel, and the slot 349. The bracket carries a guideway 359 for slide 361. The spreader finger 339 of each spreader unit 335*a* and 335*b* is pivoted at one end as indicated at 353 on the slide and extends slidably through a slot 365 in a head 367 pivoted as indicated at 369 on the guideway adjacent one end constituting the inner end of the guideway.

Figure 33:
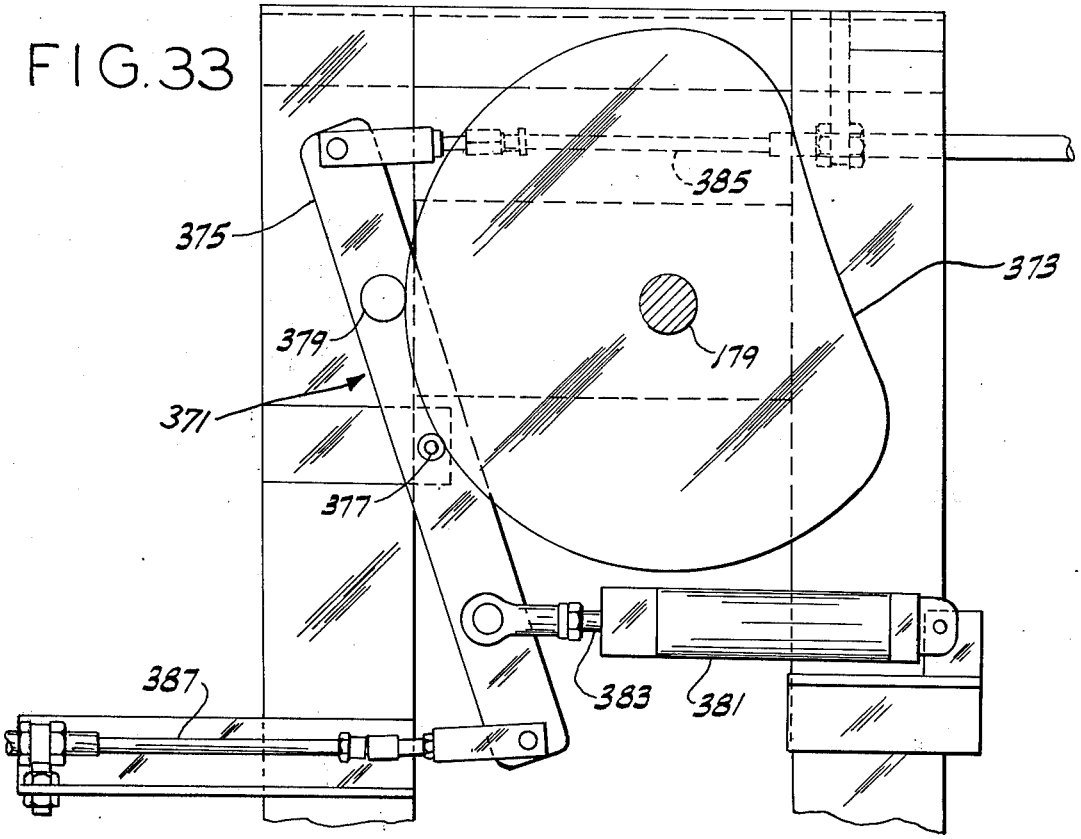
FIG. 33 is a view of the operating mechanism for the bag spreading means.

The spreader fingers 339 are adapted to be moved into the bag and then swung laterally outwardly to spread the bag flat at its mouth by means indicated generally at 371 including an edge cam 373 (see FIGS. 33 and 34), which may be referred to as the spreader cam, mounted on the camshaft 179 along with cams 177 and 285, and a cam follower lever 375 pivoted intermediate its ends at 377 on the subframe F1 carrying a cam follower roller 379 engageable with the periphery of the cam 373. An air cylinder 381 has its piston rod 383 connected to the lever for biasing the follower roller 379 into engagement with the periphery of the cam 373. A flexible push-pull cable 385 interconnects the upper end of the lever 375 with the slide 361 of the right-hand spreader unit 335*b* and a similar ɔle 387 interconnects the lower end of the lever with : slide 361 of the left-hand spreader unit 335*a*.

Figure 35:
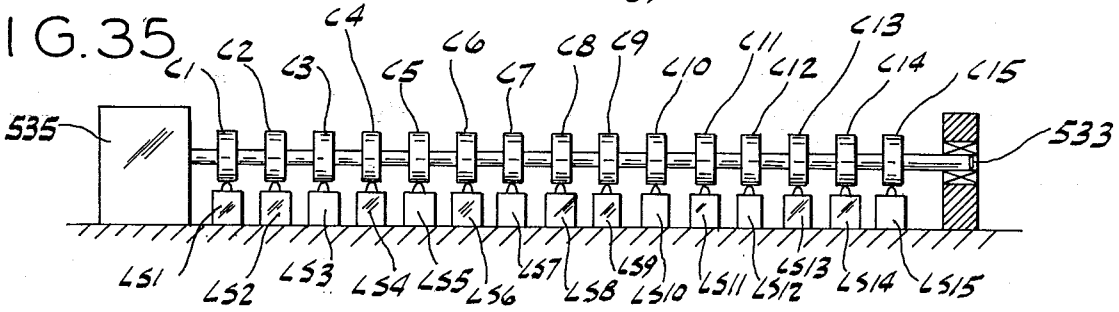
FIG. 35 is a view showing a programmer.
Figure 34:
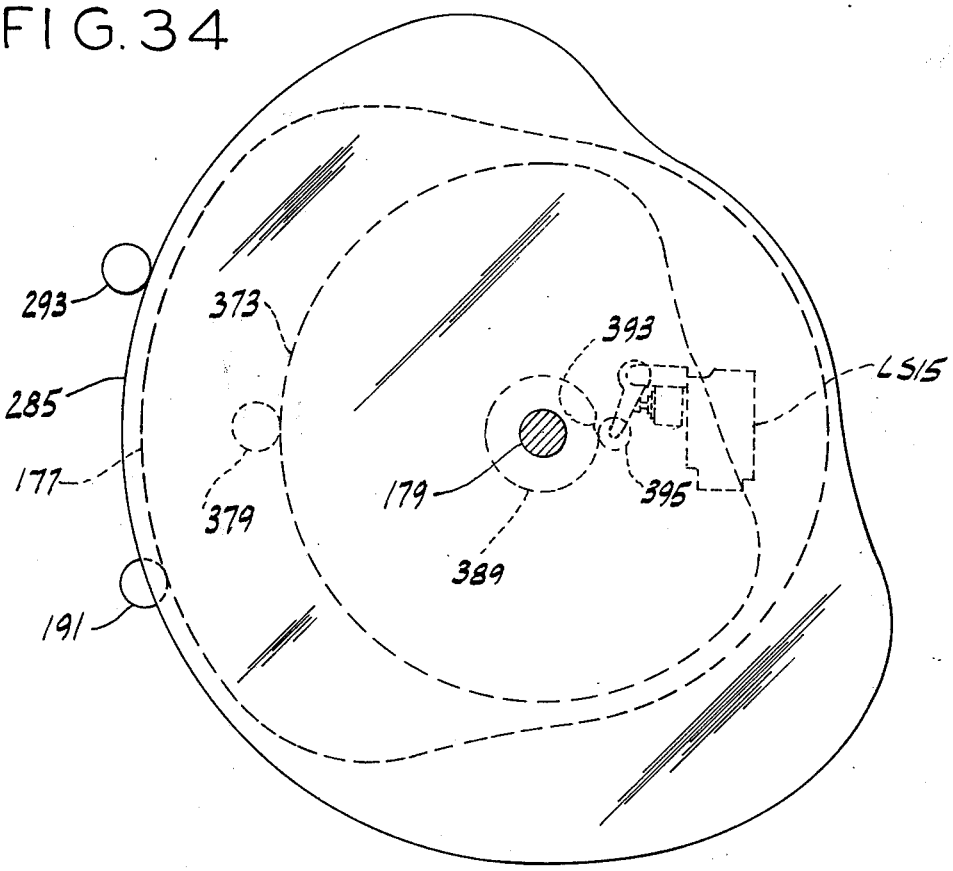
FIG. 34 is a cam diagram showing a bag opener cam, a bag spreader cam and a bag sealer cam.

'he profiles and phasing of the bag opener cam 177, : bag sealer cam 285 and the bag spreader cam 373 shown in FIG. 34. Secured on the camshaft 179 ng with these three cams is a cam 389 for actuating witch LS15 for starting the programmer 391 illus- ted in FIG. 35, as will appear. The cam 389 com- ses a disk having a notch 393, the switch LS15 hav- an operating arm carrying a roller 395 adapted to ɔp into the notch for momentary actuation of the tch once each revolution of the cam 389.

Figure 13:
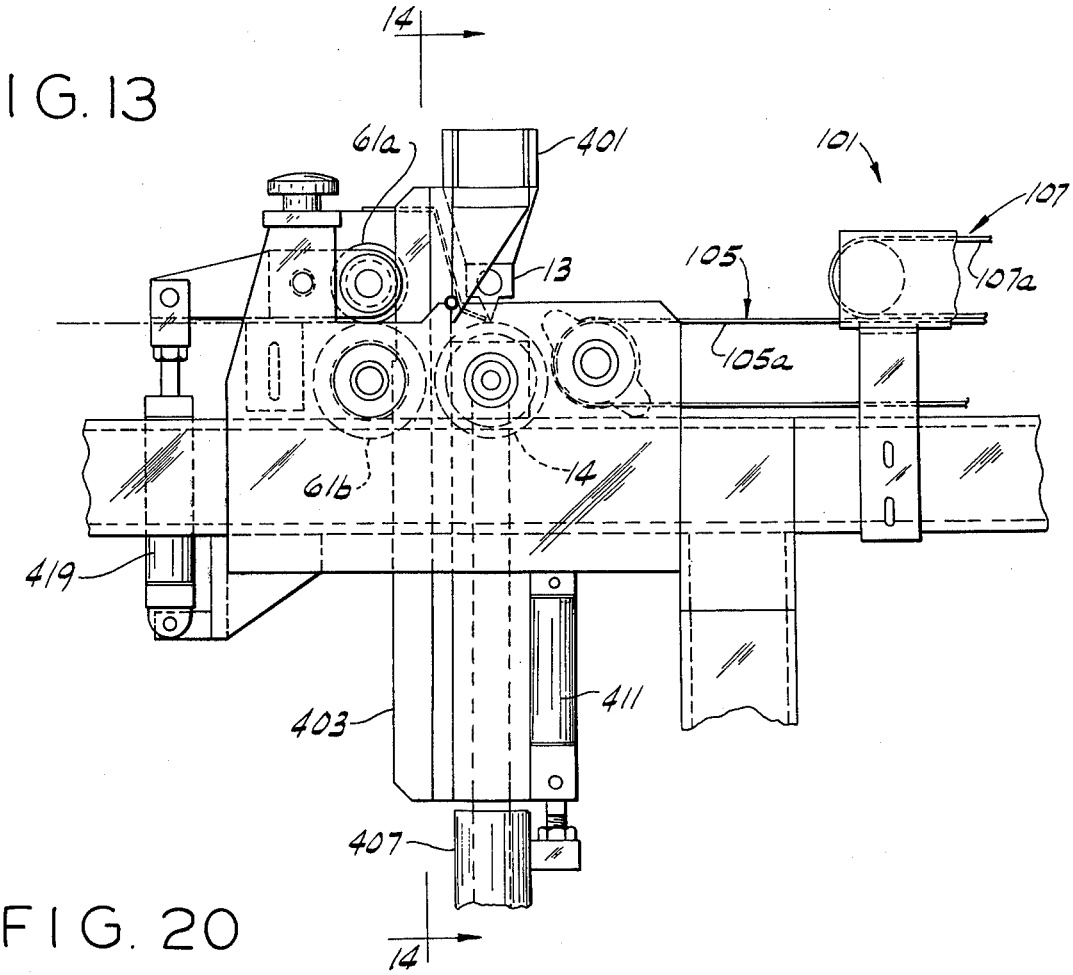
FIG. 13 is a side elevation of a bag side sealing unit of the apparatus, also showing part of a first bag conveyor of the apparatus.
Figure 20:
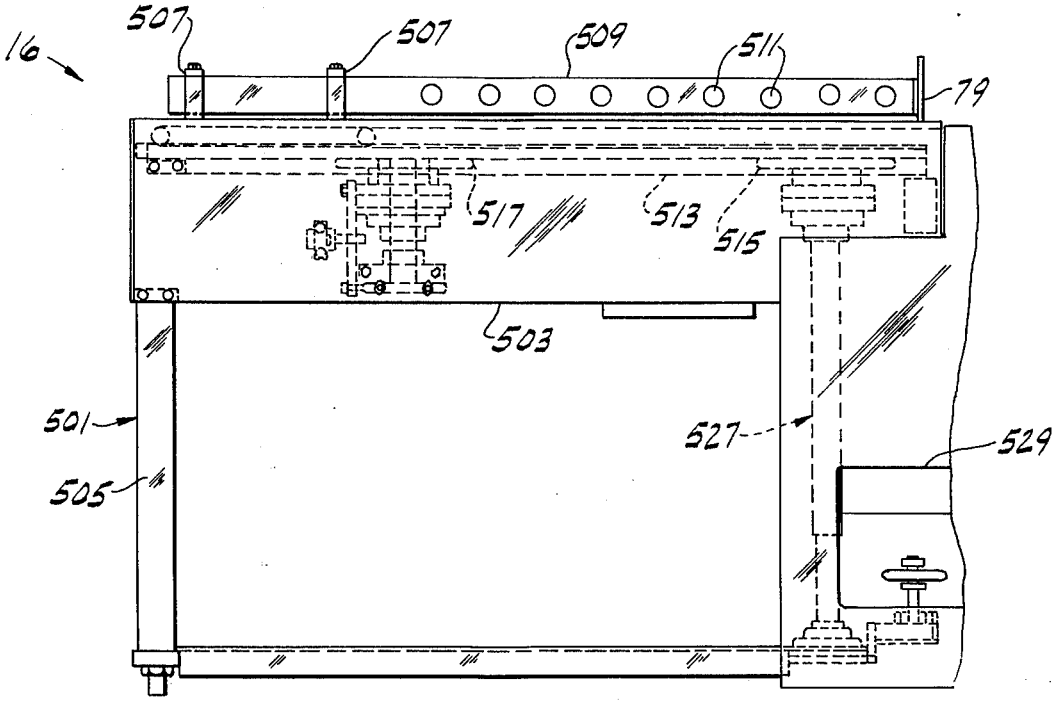
FIG. 20 is a view in elevation of the loader as viewed from the right in FIG. 17.
Figure 14A:
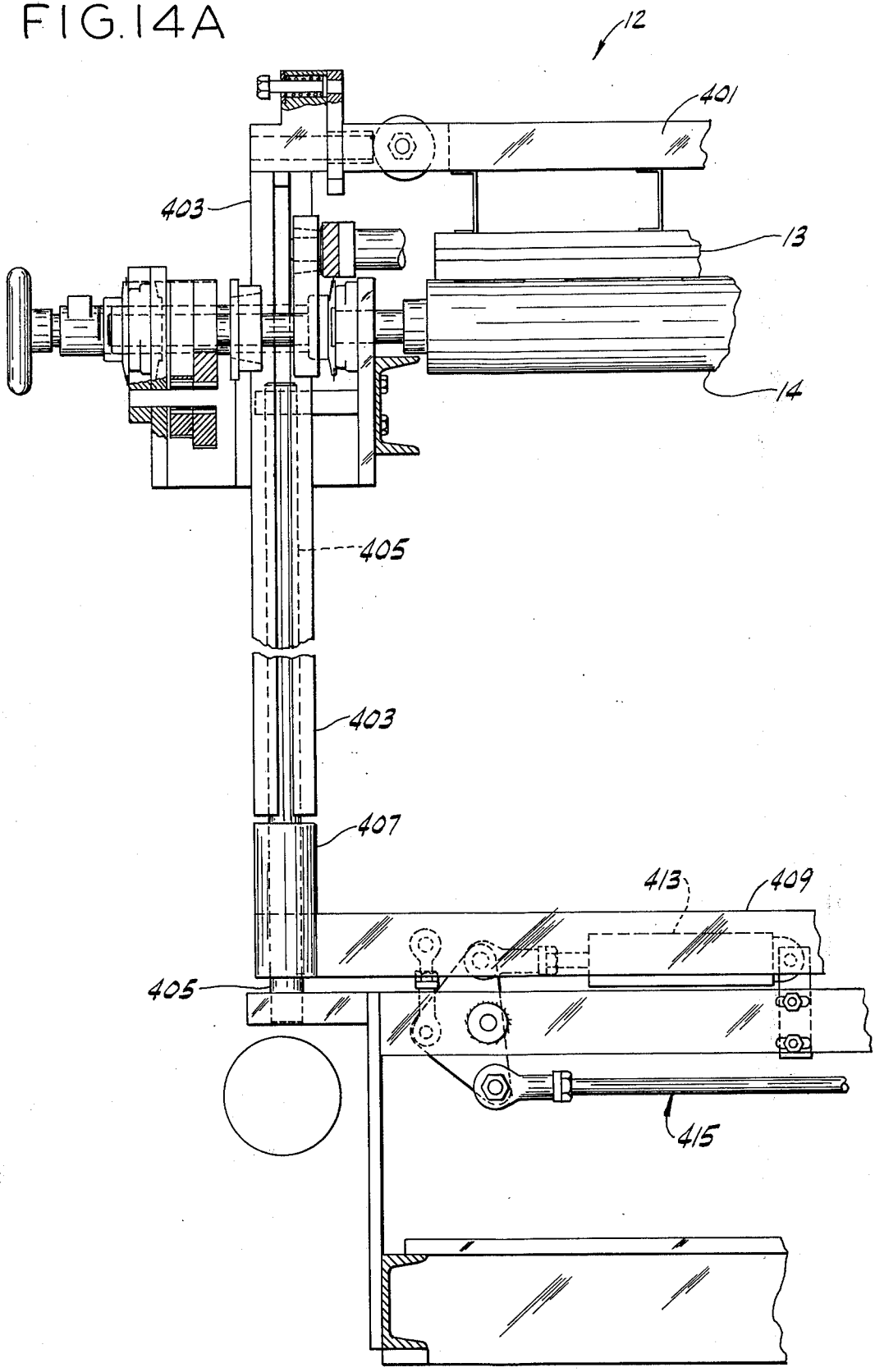
FIG. 14A and B taken together constitute a vertical transverse section generally on line 14—14 of FIG. 13 showing details of the bag side sealing unit.
Figure 14B:
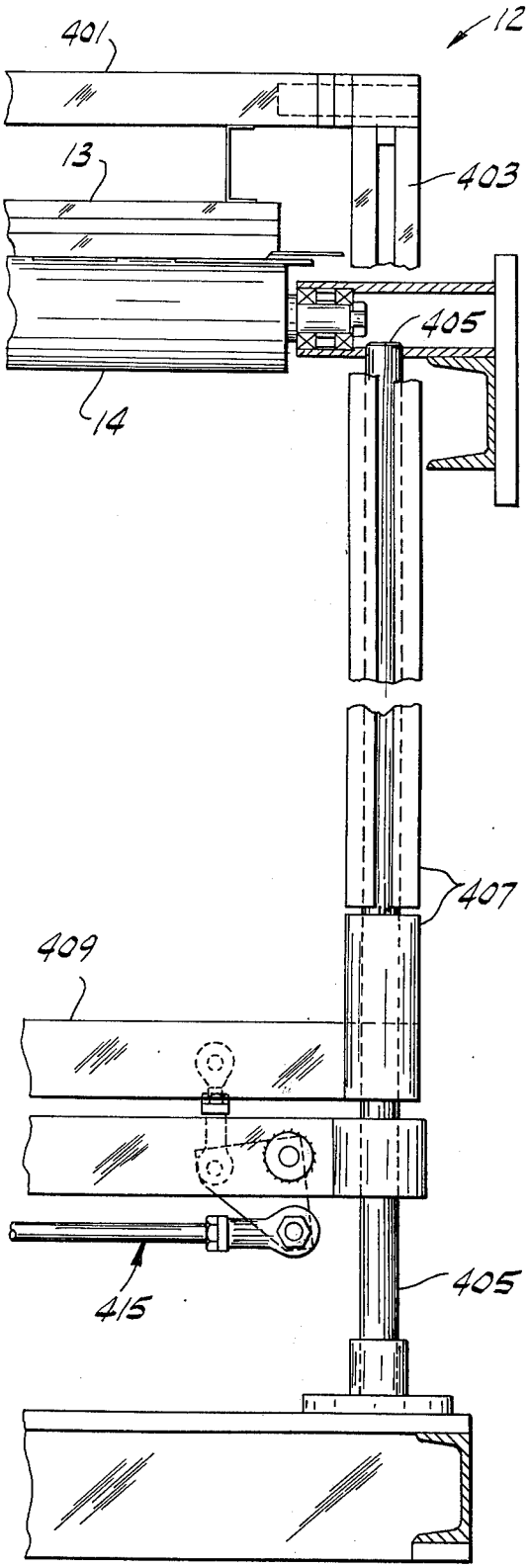
Figure 21:
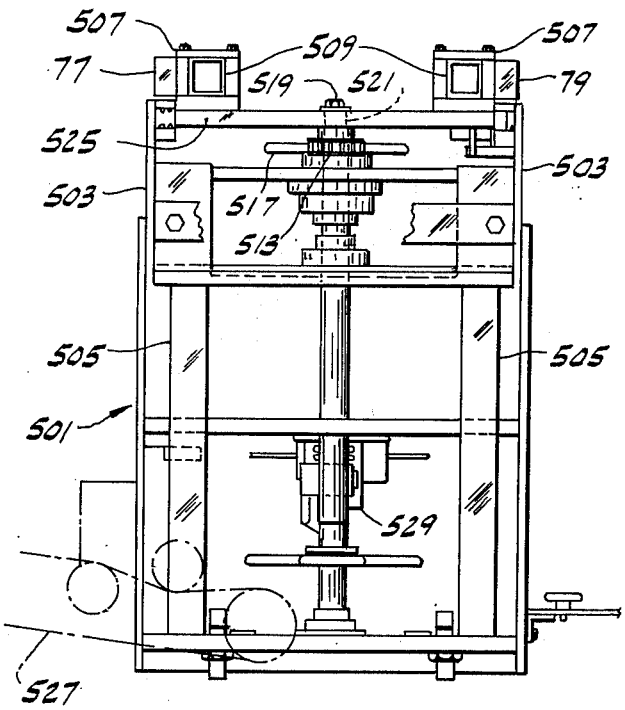
FIG. 21 is an end elevation of the loader as viewed from the left in FIG. 20.
Figure 17:
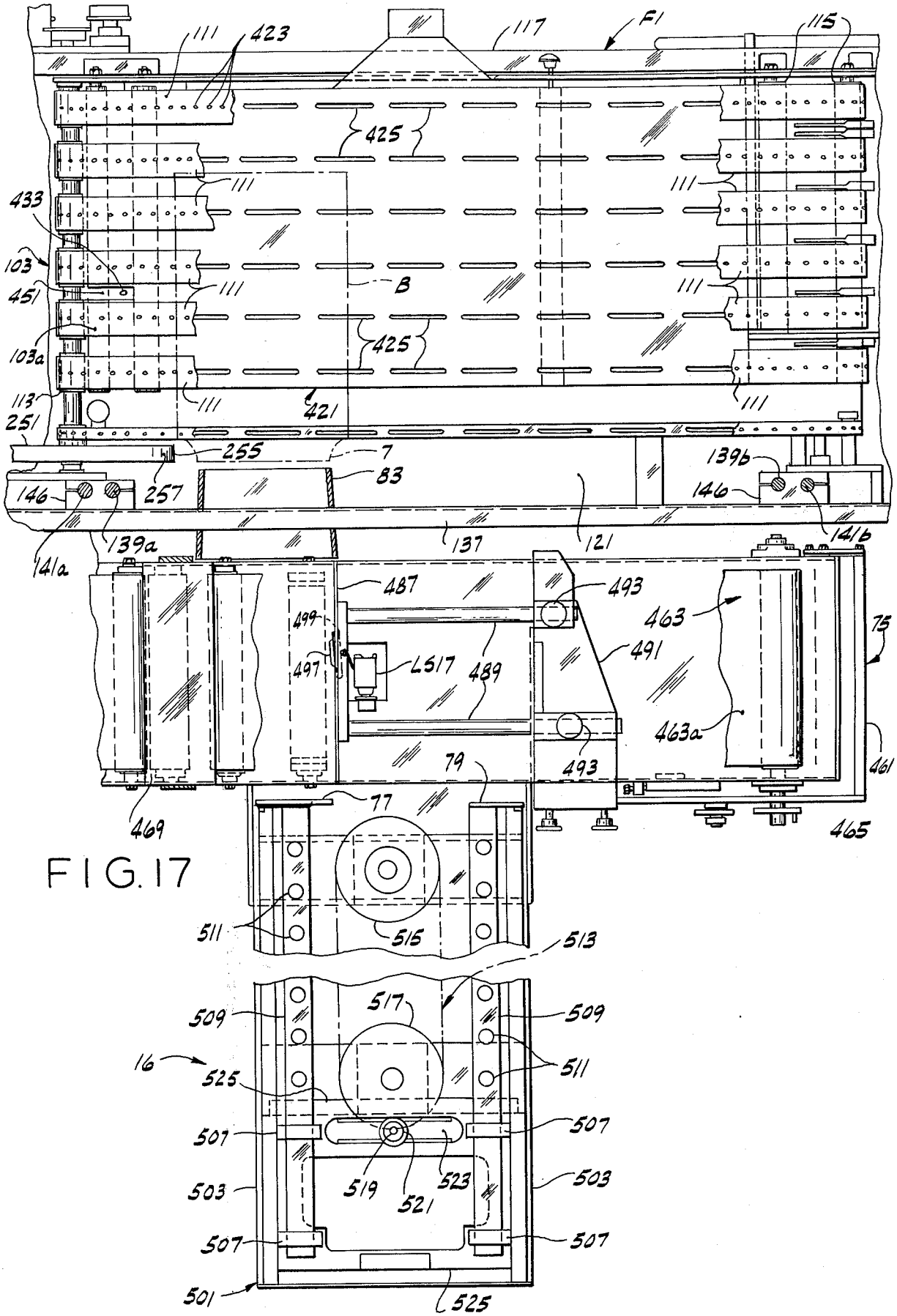
FIG. 17 is an enlarged fragment of FIG. 11, with parts broken away, showing a second bag conveyor, part of an article infeed conveyor, and a loader.
Figure 22:
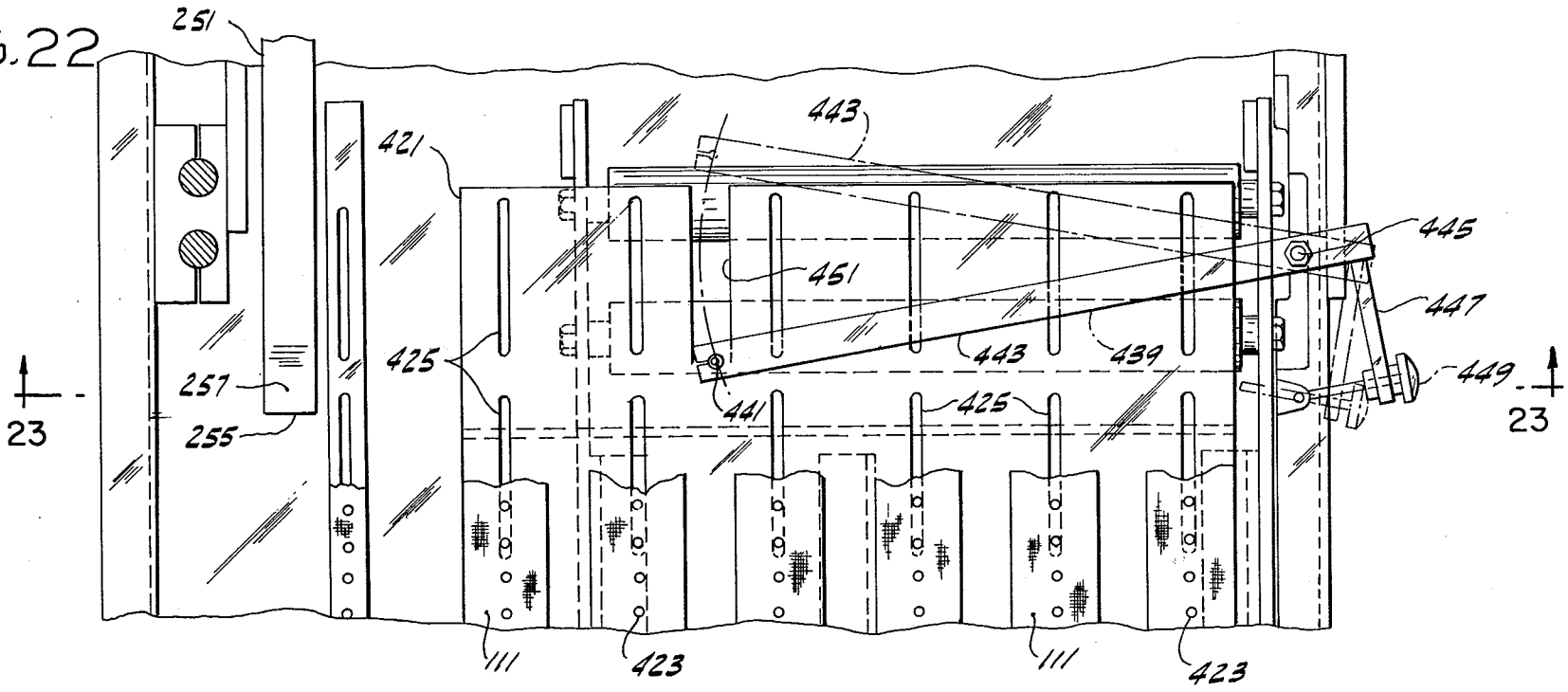
FIG. 22 is an enlarged fragment of FIG. 17, with parts broken away and parts omitted, showing a system for stopping a bag at the loading station.
Figure 23:
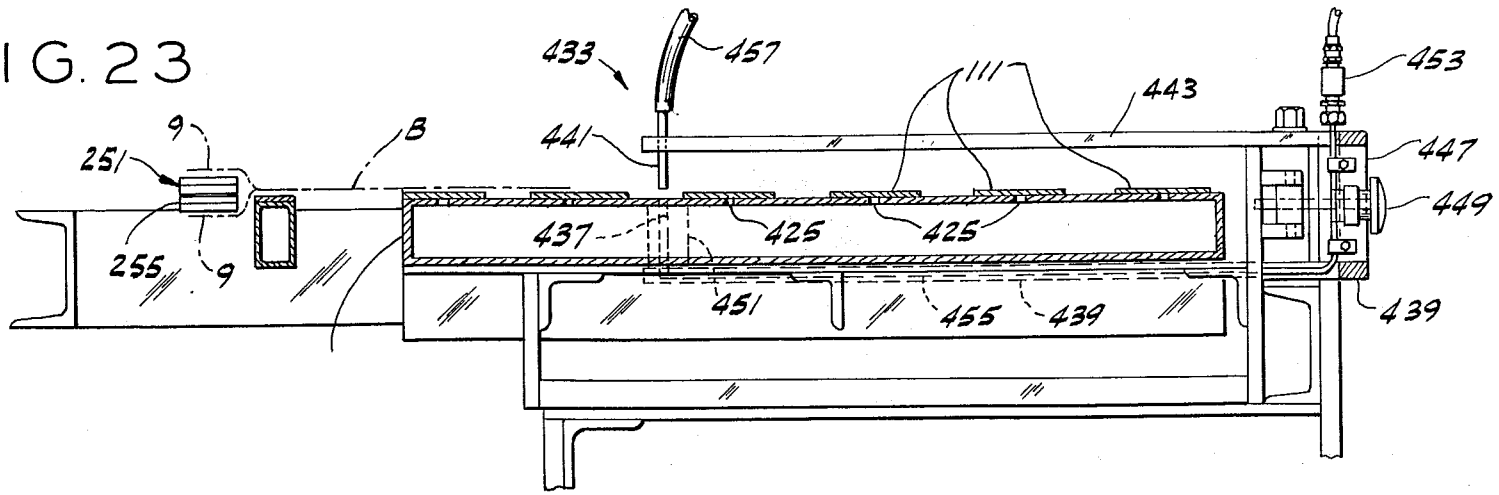
FIG. 23 is a vertical transverse section on line 23—23 of FIG. 22.

:eferring to FIGS. 13 and 14, the knife 13 is shown be mounted on the bottom of a vertically movable ım 401 extending transversely across the apparatus ɔve the back-up roll 14. Extending down from the ım at opposite ends thereof are slides 403 which are tically slidable on stationary vertical guide rods 405. 407 are indicated lower slides vertically slidable on .s 405 below the upper slides 403, these lower slides ng connected one to the other by a yoke 409 and ng connected to the upper slides via air cylinders l. The yoke is movable up and down by an air cylin- 413 to raise and lower the lower slides 407, and via air cylinders 411 to raise and lower the upper slides } and the beam 401 and knife 13. Air cylinder 413 :rates the yoke via a parallelogram linkage 415. Air ınders 411 interposed between the lower slides 407 l the upper slides 403 permit control of pressure of knife 13 on the back-up roll 14, and are operable to :k the knife off (upwardly) from the roll 14 when the ıaratus stops, thereby to avoid burning of the roll 14, ch typically has a rubber sleeve covered with "Te- ı"-impregnated glass cloth. The feed rolls 61*a* and ) (which may also be referred to as the draw rolls) of bag side seal unit are adapted to be driven via a /e 417 including an electric clutch and brake unit } (see FIG. 36B) when the knife 13 is raised to feed ward a bag width increment of the center-folded ) W between the knife 13 and the back-up roll 14. cylinders such as indicated at 419 bias the upper w roll 61*a* down toward the lower draw roll 61*b* to ) the web W. Suitable gearing (not shown) intercon- ts the lower draw roll 61*b* and the back-up roll 14 to ıte the back-up roll on each cycle of operation of draw rolls at a greater rate than the draw rolls so as :hange the region of the back-up roll presented to knife on successive cycles.

ı the second bag conveyor 103, the upper reaches *a* of the endless belts 111 travel over a vacuum box (see FIGS. 17 and 23). Each of these belts has a es of perforations 423 on its longitudinal center line ch, in the upper reach of the belt, travels over a es of slots 425 in the top of the vacuum box. The :r is continuously evacuated by means of a suitable ıum pump 427 (see FIG. 36A). Vacuum is applied bag on the upper reaches of the belts via the slots in the top of the vacuum box and the holes 423 in belts to grip the bag to the belts. Conveyor 103 is pted to be driven via a drive indicated generally at including an electric clutch and brake unit 431 : FIG. 36B). The clutch is actuated and the brake is :tuated to start the conveyor somewhat before a is delivered to it by the first conveyor 101, and ıes up to the same rate of speed as the conveyor 101 before the bag is delivered to it by the first con- ɔr 101. Then it feeds the bag forward to the loading on 2 and stops with the bag in loading position substantially centered in respect to the loader 16 (i.e., centered in respect to the item A to be bagged). The stopping of the conveyor 103 with the bag in loading position, and with the bag flaps 9 in the clamps 10 and 11, is effected via means including a sensor 433 (see FIGS. 22 and 23) for sensing passage of the trailing edge of the bag over a fixed point related to the loading position of the bag, this sensor controlling a switch 435 (see FIG. 36B) for deactuating the clutch and actuating the brake of the clutch/brake unit 431 quickly to stop the conveyor 103. As herein illustrated, the sensor 433 comprises a lower air delivery jet 437 mounted on a lower arm 439 and an upper air receiver tube 441 mounted on an upper arm 443 in line with the air jet 437. Arm 439 extends under and arm 443 extends over the vacuum box 421 at its rear (trailing) end from one side of the box, these arms being pivoted as indicated at 445 for swinging adjustment about a vertical axis at one side of the box and being connected together by a yoke 447 for conjoint swinging on this axis. An adjustment screw for the arms is indicated at 449. The air jet 437 extends up from the lower arm 439 in a notch 451 at the rear end of the vacuum box nearly to the top of the box, and is adapted to be supplied with air via a swivel connection at 453 and a pipe 455 extending along the lower arm 439 to the jet. The jet 437 and tube 441 are adjustable to different positions longitudinally in respect to the notch 451 as indicated by the arc in FIG. 22 for different bag widths by turning the screw 449 to swing the arms 439 and 443. A flexible conduit 457 connects tube 441 to the switch 435, which is a conventional pressure switch, the arrangement being such as to actuate the switch when air from jet 437 blows up into the tube 441 and thus pressurizes the switch via conduit 457. The supply of air to the jet 437 is under control of a solenoid valve AV7 which is opened in timed relation to the forward feed of a bag to deliver air to the jet when the leading edge of the bag passes the jet. The air issuing from the jet is then blocked from entering the receiver tube 441 by the bag until the trailing edge of the bag passes the jet. Air then blows upwardly from the jet into the tube 441 to activate the switch 435 and stop the conveyor 103 with the bag in the loading position.

Referring to FIGS. 10, 11, 17–19 and 19A, the product infeed conveyor 75 is shown to comprise a relatively long narrow table 461 extending along the right side of the bag side seal unit 12 and the bag conveyor means 69 and an endless belt 463 trained around rolls as indicated at 465 to have a horizontal upper reach 463*a* adapted to travel over the top of the table in the direction of the arrow shown in FIG. 18, which is the forward direction, and a return reach 463*b* under the table top. Intermediate its length, the upper reach 463*a* may have a dip 467 under a table top section 469 where provision may be made for means (not shown) for compressing the product if so desired. The table has left and right side guides 471 and 473 for the product, these guides being adjustable laterally of the table by means such as indicated at 475 for handling products of different width. The right side guide 473 carries a switch LS16 having an operating arm 479 engageable by a product unit A being fed forward by the conveyor between the guides to actuate the switch to signal that a unit A has passed. The belt 463 is adapted to be continuously driven in the direction for forward travel of its upper reach 463*a* by a variable speed motor 481 and a chain and sprocket drive 483 from the motor to the roll 465 for the belt at the downstream end of the conveyor. At 485 is indicated means for arresting a unit A fed forward by the product infeed conveyor 75 at the loading station 2 in position to be pushed into an opened bag by the loader 16. This means comprises a stop plate 487 on the rearward (upstream) end of a pair of rods 489 extending forward from a bridge 491 extending from side-to-side of the table 461 over the upper reach of the belt 463 adjacent the downstream end of the table. The rods 489 are longitudinally adjustable in the bridge 491 to adjust the position of the stop plate 487 longitudinally of the product infeed conveyor 75 and are held in adjusted position by set screws 493. The stop plate 487 carries a switch LS17 and a pivoted operating arm 497 for the switch reaching through an opening 499 in the plate for engagement by a unit A to actuate the switch as the unit A engages and is arrested by the plate. Once the unit A has been arrested, the upper reach of the belt 463 (which is travelling continuously) simply slides under the unit A.

Referring to FIGS. 11, 17, 20 and 21 the loader 16 is shown to comprise a frame 501 including a pair of side rails 503 on legs 505. On these side rails are guides 507 in which are slidable elongate push rods or rams 509 having the pusher plates 77 and 79 at their forward ends. These push rods, as shown, may be of hollow box section with holes as indicated at 511. The means 81 for advancing and retracting the pusher plates comprises an endless chain 513 trained around sprockets 515 and 517 with a pin 519 extending up from the chain carrying a roller 521 slidable laterally with respect to the side rails 503 in a slot 523 in a yoke 525 connecting the rods 509. The chain is adapted to be driven through a cycle for advancing and retracting the rods and pusher plates by drive means such as indicated at 527 including an electric clutch and brake unit 529 (see also FIG. 36A).

The programmer 391 (see FIG. 35) is provided for programming the operation of the apparatus in proper timed sequence in response to delivery of a product unit A to the loading station 2 (more particularly in response to actuation of the switch LS17 by the unit A as it is stopped at the loading station by the stop plate 487). The programmer basically comprises a camshaft 533 carrying a set of cams C for actuating, in proper timed sequence, a set of limit switches LS. The camshaft 533 is adapted to be driven through a one-revolution cycle by an electric clutch and brake unit 535, in response to actuation of the stop plate switch LS17 (and under control of switches LS15 and LS16).

The apparatus has a main drive motor 537 (see FIG. 36A) which is suitably connected for continuously driving the camshaft 179 carrying the bag opener cam 177, the bag sealer cam 285, the bag spreader cam 373 and the programmer control cam 389, and also for continuously driving the inputs of the clutch and brake units 418, 431, 529 and 535 for the draw rolls 61*a* and 61*b*, the conveyor 103, the loader 16 and the programmer 531. While the bag opener cam 177, the bag sealer cam 285 and the bag spreader cam 373 are continuously driven by the motor 537, they do not actuate their respective followers 191, 293 and 379 until their respective air cylinders 193, 325 and 381 are empowered to hold the respective followers against the cams. A motor VM (see FIG. 36A) is operated continuously to drive the vacuum pump 427 for evacuating the vacuum box 421. Motor 481 for driving the product infeed conveyor 75 is operated continuously to drive belt 463 of this conveyor. At 539 in FIG. 36B is indicated a motor for continuously driving the draw rollers 33 for continuously feeding the center-folded web W into the accumulator 39, control means for this motor (details of which are not critical) being indicated at 540.

Figure 36A:
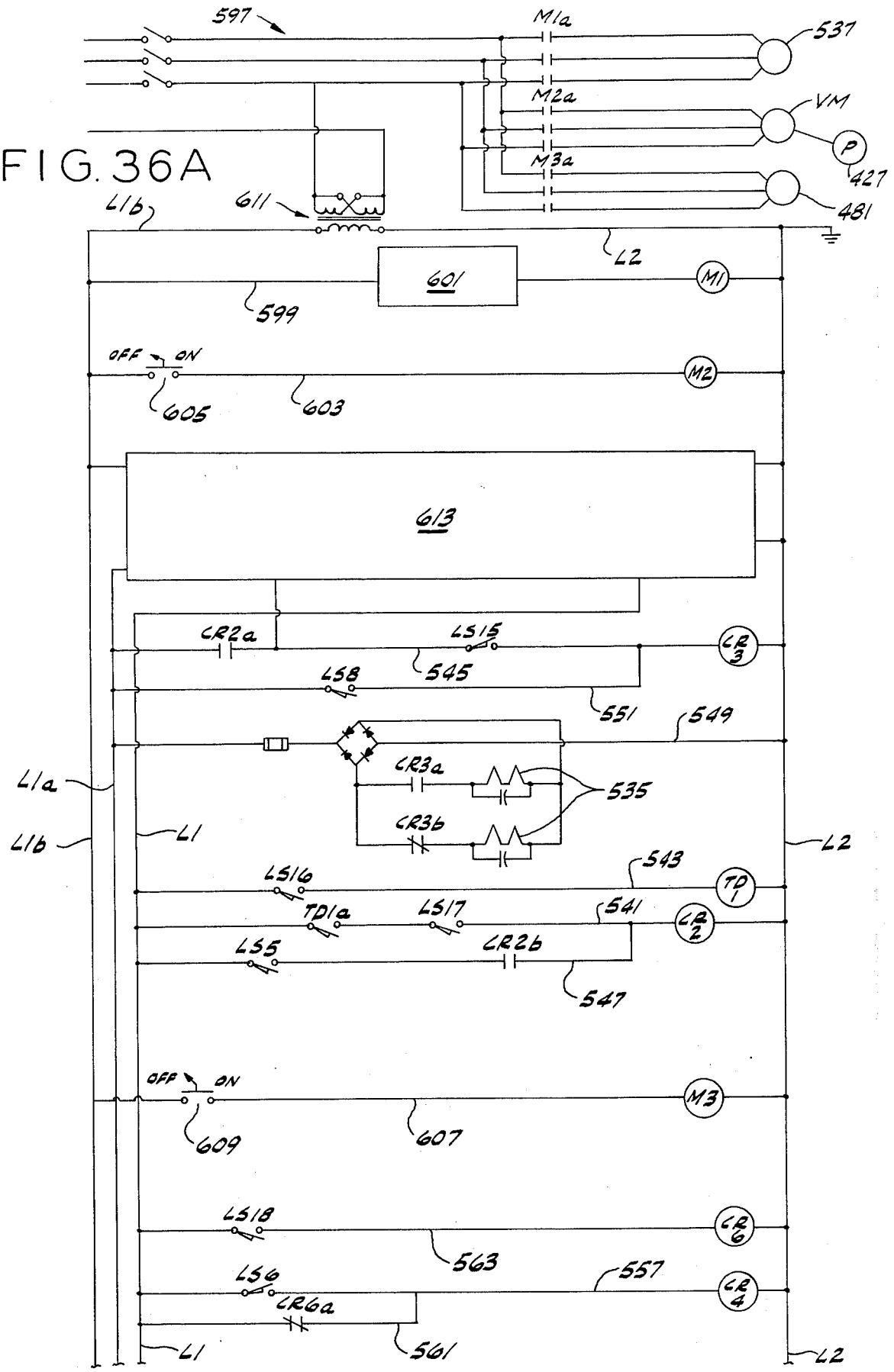
FIGS. 36A and 36B taken together constitute a wiring diagram.
Figure 36B:
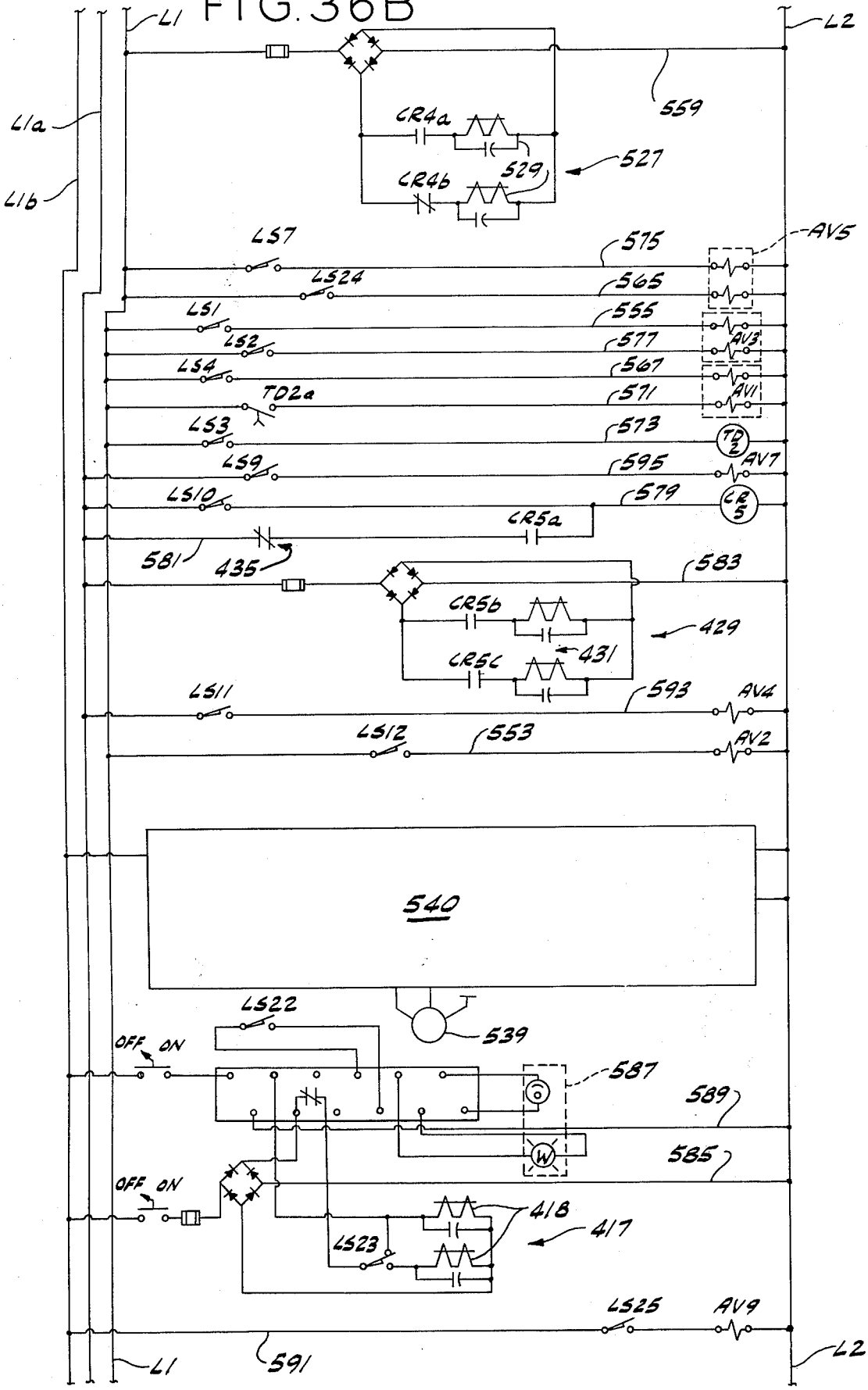

The circuitry of the apparatus is illustrated in FIGS. 36A and B, and the operation of the apparatus, with reference thereto, is as follows:

A bag opening, loading, spreading and sealing cycle may be regarded as starting when a product unit A fed forward by the product infeed conveyor 75 is stopped at the loading station 2 by the stop plate 487 and actuates the stop plate switch LS17, which as shown in FIG. 36A, is connected in series with a relay CR2 and contacts TD1*a* of a time-delay relay TD1 in a line 541 across power lines L1 and L2. The unit A, in the course of its forward travel to the stop plate 487, actuates switch LS16, which may be referred to as the backlog switch and which is connected in series with the time-delay relay TD1 in a line 543 across lines L1 and L2, thus closing contacts TD1*a*. Upon closure of switch LS17, relay CR2, is energized, thereby closing its contacts CR2a connected in series with switch LS15 and a relay CR3 in a line 545 across lines L1*a* and L2, and closing its contacts CR2*b* connected in series with a switch LS5 in a holding circuit 547 around contacts TD1*a* and switch LS17. With contacts CR2*a* closed, on the momentary closure of switch LS15 when the roller 395 drops into the notch 393 of the cam 389, relay CR3 is energized to close its contacts CR3*a* and open its contacts CR3*b* in a circuit 549 connected across lines L1*a* and L2 for the programmer clutch and brake unit 535. This energizes the clutch and deenergizes the brake of this unit, to start driving the programmer camshaft 533 through a one-revolution cycle. Cam C8 on the programmer camshaft 533 actuates switch LS8 which is connected in a holding circuit 551 around contacts CR2*a* and switch LS15 to hold relay CR3 energized thereby to maintain the programmer camshaft 533 in operation for a full single-revolution cycle thereof, as determined by cam C8 opening switch LS8.

As a result of a previous cycle, there will be a bag B at the loading station 2 with its upper flap 9 between the open jaws 10*a* and 10*b* of the upper clamp 10, and with its lower flap 9 between the open jaws 11*a* and 11*b* of the lower clamp 11. As the programmer camshaft 533 rotates through its single-revolution cycle, the first operation in the sequence is that cam C12 actuates switch LS12 connected in series with an air valve AV2 in a line 553 across lines L1 and L2. This valve, on being energized, supplies air to cylinder 219 to close jaw 10*a* of the upper clamp 10 and jaw 11*b* of the lower clamp 11 thereby to clamp both the upper and lower bag mouth flaps 9. FIG. 8 diagrammatically illustrates this clamping of the flaps.

Cam C1 actuates switch LS1 connected in series with an air valve AV3 in a line 555 across lines L1 and L2. This valve, on being energized, directs air to cylinder 193 for engagement of the follower 191 with the bag opener cam 177 for actuation of the follower 191 by cam 177 to raise the upper clamp 10 to open the mouth of the bag (see FIGS. 8 and 28). The rise of the upper clamp 10 is mechanically effected by the bag opener cam 177, which is profiled and phased as shown in FIG. 34 to effect the rise of the upper clamp after actuation of cylinder 219 to close the jaws of the upper and lower clamps to clamp the bag mouth flaps 9, and a dwell of the upper clamp in its raised position (and closed) to hold the bag mouth open for a loading interval during which the loader 16 functions to load the bag.

Cam C6 actuates switch LS6 connected in series with a relay CR4 in a line 557 connected across lines L1 and L2 to energize this relay and close its contacts CR4*a* and open its contacts CR4*b* in a circuit 559 connected across lines L1 and L2 for the loader clutch and brake unit 529. Relay CR4 is held energized via a holding circuit 561 including the normally closed contacts CR6*a* of a relay CR6 connected in series with a switch LS18 in a line 563 across lines L1 and L2. Switch LS18 is controlled by the loader 16, being opened by one of the loader rams 509 when it is retracted. Thus, on energization of relay CR4, unit 527 is actuated to drive the loader 16 through a cycle comprising forward movement of the rams 509 to push a unit A off the conveyor 75 through the funnel 83 over the lower clamp 11 into the opened bag B at the loading station 2, followed by retraction of the rams. As the rams reach their retracted position, switch LS18 is opened to deenergize relay CR6, thereby opening its normally closed contacts CR6 *a* to deenergize relay CR4 to deactuate the clutch and brake unit 529 and stop the loader 16. The upper and lower clamps 10 and 11 are held closed by cylinder 219 during the loading operation tightly gripping the upper and lower bag mouth flaps 9 to enable the unit A to be pushed into the bag B without having the bag pushed back by the unit A. The timing is such that the rams 509 start forward slightly in advance of the upper clamp 10 reaching its fully open position, and complete their forward movement and retraction during the dwell of the upper clamp 10 in its raised position. For relatively narrow units A, only pusher plate 77 is used. For wider loads, both pusher plates 77 and 79 are used.

Cam C12 times out the actuation of switch LS12 to deenergize valve AV2 to open the upper and lower clamps 10 and 11 to release the bag flaps 9 upon retraction of the rams 509 to enable the spreading and sealing of the bag. Cam C24 actuates switch LS24 connected in series with an air valve AV5 in a line 565 across lines L1 and L2 to energize this valve to direct air to cylinder 381 for engagement of the bag spreading cam follower 379 with the bag spreading cam 373 for actuating the spreaders 335*a* and 335*b* to spread flat the mouth end of the bag (see FIG. 31). Operation of the spreaders is mechanically effected by the bag spreader cam 373, which is profiled and phased as shown in FIG. 34 to actuate the cables 385 and 387 to move the spreader fingers 339 into the bag, then outwardly to spread it flat, and then to dwell for an interval for the sealing of the bag. As shown in FIG. 31, the fingers 339 when moved to the bag-spreading position remain clear of the bag sealer bars 257 and 259.

Cam C4 actuates switch LS4 connected in series with air valve AV1 in a line 567 across lines L1 and L2 to operate this valve to direct air to cylinder 325 to advance follower 293 into engagement with the bag sealer cam 285 for operating the bag sealer bars 257 and 259. Operation of the sealer bars is mechanically effected by the bag sealer cam 285, which is profiled and phased as shown in FIG. 34 to close the sealer bars on the spread-flat mouth end portion of the bag to heat-seal it on a line of seal extending across the bag spaced inwardly from the tips of the spreader fingers, to hold the bars closed for an interval to complete the sealing operation, and then to open the bars. On higher speed operation, the sealer bars are opened by the bag sealer cam 285. On lower speed operation, the sealer bars are opened by operating valve AV3 to deactuate cylinder 325 to retract the follower. For the latter mode of operation, valve AV1 is connected in series with contacts TD2*a* of a time-delay relay TD2 in a line 571 across lines L1 and L2. This relay TD2 is connected in series with switch LS3 actuated by cam C3 in a line 573 across lines L1 and L2. Cam C3 functions to energize relay TD2 and start the time-delay interval running when the sealed bars close.

The bag spreader cam 373 functions to start retracting the bag spreading fingers 339 generally simultaneously with the closure of the heat-sealing bars 257 and 259 on the spread-flat bag to start the bag sealing operation. Cam C7 actuates switch LS7 connected in series with air valve AV5 in a line 575 across lines L1 and L2 to actuate this valve to operate the air cylinder 381 to release the cam follower 377 from the cam 373. The heat seal bars 257 and 259 remain closed in pressurized engagement with the bag to form a heat seal across the bag from one side thereof to the other, and then are opened as above described. The upper clamp 10 is lowered by the action of the bag opener cam 177, and cam C2 actuates switch LS2 connected in series with air valve AV3 in a line 577 across lines L1 and L2 to actuate this valve to operate the air cylinder 193 to release the bag opener cam follower 191 from the bag opener cam 177.

Now, with the upper clamp 10 down, the upper and lower clamps 10 and 11 open, the sealer bars 257 and 259 in their retracted position (i.e., 257 up, 259 down), cam C10 actuates switch LS10 connected in series with a relay CR5 in a line 579 across lines L1*a* and L2. This closes contacts CR5*a* in a holding circuit 581 around switch LS10 including normally closed pressure switch 435 (which is controlled by bags being fed forward by conveyor 103). It also closes contacts CR5*b* and opens contacts CR5*c* in a circuit 583 connected across lines L1*a* and L2 for the clutch and brake unit 431 for driving conveyor 103. This energizes the clutch and deenergizes the brake of unit 431 to start driving conveyor 103 to transport the loaded bag B forward away from the loading station and deliver it to the take-away conveyor 85.

While a bag B is being loaded at the loading station 2, another bag B is being formed in the bag-forming section. In this regard, cam C23 actuates switch LS23 connected across lines L1*b* and L2 in a circuit 585 for the clutch and brake unit 418 for driving the web feed rolls 61*a*, *b* in the bag-forming section. This energizes the clutch and deenergizes the brake of unit 418 to drive the rolls 61*a*, *b* to feed the web forward. The clutch is deenergized and the brake is energized to stop the rolls 61*a*, *b* when a bag width of the web has been fed forward by an electric eye 587 (which scans index marks spaced at bag width intervals on the web) connected across lines L1*b* and L2 in a circuit 589 including switch LS22 actuated by cam C22 for resetting the electric eye. Cam C25 actuates switch LS25 connected across lines L1*b* and L2 in a circuit 591 including an air valve AV9. This valve, on being energized, directs air to cylinder 413 (FIG. 14A) to pull down the heated knife 13 to sever a bag B from the web and form its trailing side seal (and the leading side seal for the next bag to be formed).

The bag B, having been severed from the web by the knife 13, cam C11 actuates switch LS11 connected across lines L1*a* and L2 in a circuit 593 including air valve AV4. This valve, on being energized, directs air to cylinder 109 to swing the upper set of belts 107 of conveyor 101 down to grip the bag and feed it forward (the upper belts 107 and the lower belts 105 are continuously driven). Conveyor 101 feeds the bag forward to conveyor 103. Cam C9 actuates switch LS9 connected in series with air valve AV7 in a line 595 across lines L1*a* and L2 to supply air to jet 437, the timing being such that air is delivered to the jet when the leading edge of the bag passes the jet. When the trailing edge of the bag passes the jet, air blows upwardly from the jet into the tube 441 to open the switch 435, thereby deenergizing relay CR5 with resultant opening of its contacts CR5*b* and closing of its contacts CR5*a* in circuit 583 to stop conveyor 103 with the bag B at the loading station 2.

Referring further to FIG. 36A, the motors 537, VM and 481 are shown as connected in a circuit 597 including contacts M1*a* of a relay M1 for motor 537, contacts M2*a* of a relay M2 for motor VM and contacts M3*a* of a relay for motor 481. Relay M1 is connected across lines L1*b* and L2 in a circuit 599 including suitable motor controls as generally indicated at 601. Relay M2 is connected across lines L1*b* and L2 in a line 603 including an on-off switch 505. Relay M3 is connected across lines L1*b* and L2 in a line 607 including an on-off switch 609. Power for the L1*b*-L2 circuit is supplied via a transformer 611. Lines L1 and L1*a* are powered from L1*b* via a circuit including suitable controls at 613 (not critical to this invention).

The apparatus is adapted to form bags B of different sizes and to handle units A of different sizes. In this regard, rolls 61*a* and 61*b* operate to feed forward the requisite bag width as determined by the spacing of the bag width index marks on the web W, and the scanning of these marks by the electric eye 587. The stop plate 487 is adjusted longitudinally of the product infeed conveyor 75 in accordance with the width of unit A to be packaged. Sensor 433 is adjusted for stopping a bag being fed forward in proper position relative to the stop plate as so adjusted. The clamps 10 and 11 and seal bars 257 and 259 are made long enough to take care of the widest bag to be formed and loaded, and this inherently takes care of bags of all lesser widths. The spreaders 335*a* and *b* are adjusted in accordance with the width of the bag.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Packaging apparatus comprising means for feeding bags sidewise to a loading station, each bag being an open mouth bag and each wall of the bag having a flap at its mouth end;

a pair of clamps at the loading station for clamping the flaps, each clamp comprising a pair of jaws movable relatively to one another between an open position for sidewise entry of a flap therebetween and a closed position for clamping the flap;

means mounting the clamps for movement relatively to one another between a flap-receiving position wherein the clamps are relatively close together and a bag-opening position wherein the clamps are spread apart, said clamps when in flap-receiving position with their jaws open being adapted for sidewise entry therein of the flaps of a bag as the bag is fed sidewise to the loading station;

means for closing the jaws of each clamp for clamping the flaps;

means for moving the clamps relatively to one another with the flaps clamped therein to said bag-opening position for opening the bag; and means at the loading station for loading the opened bag.

2. Packaging apparatus as set forth in claim 1 having flap separating means on opposite sides of which the flaps of a bag travel as the bag is fed forward to the loading station.

3. Packaging apparatus as set forth in claim 2 wherein said flap separating means has means at its end toward the clamps for spreading the flaps for sidewise entry thereof between the open jaws of the respective clamps.

4. Packaging apparatus as set forth in claim 1 wherein said bag feeding means comprises conveyor means for feeding a bag forward to the loading station in a generally horizontal plane, wherein the clamps extend generally horizontally at the loading station, one clamp constituting an upper clamp for clamping the flap of the upper wall of the bag and the other clamp consituting a lower clamp for clamping the flap of the lower wall of the bag, and wherein the loading means comprises means for pushing a unit to be packaged into the opened bag at the loading station.

5. Packaging apparatus as set forth in claim 4 having means for feeding units to be packaged to the loading station for being pushed into an opened bag by the pushing means.

6. Packaging apparatus as set forth in claim 5 wherein one jaw of each clamp constitutes an upper jaw of the clamp and the other constitutes a lower jaw of the clamp, the upper jaw of the lower clamp being fixed generally in said horizontal plane and the lower jaw of the lower clamp being movable upwardly toward the upper jaw of the lower clamp to clamp the lower flap, the upper clamp when in its flap-receiving position being located above and adjacent the upper jaw of the lower clamp and being movable upwardly away from the latter to open a bag.

7. Packaging apparatus as set forth in claim 6 having means for supporting a unit for being pushed by said pushing means over the upper jaw of the lower clamp into the opened bag.

8. Packaging apparatus as set forth in claim 7 wherein the upper and lower jaws of the upper clamp are carried by a vertically movable carriage with the lower jaw fixed on the carriage and the upper jaw vertically movable on the carriage toward and away from the lower jaw.

9. Packaging apparatus as set forth in claim 1 having means for sealing the bag at the loading station after the bag has been loaded.

10. Packaging apparatus as set forth in claim 9 having means at the loading station for spreading flat the mouth end of the opened bag at the loading station preparatory to sealing the bag.

11. Packaging apparatus as set forth in claim 1 having means for forming the bags sidewise from a continuous supply of bag material, each bag being formed with said flaps and, after it has been formed, being fed forward sidewise by said feeding means to the loading station.

12. Packaging apparatus as set forth in claim 11 wherein said bag forming means comprises means for severing a continuous center-folded web of flexible heat-sealable sheet material on lines extending transversely across the web spaced at bag width intervals and heat-sealing the web on opposite sides of said line to form a seal at the trailing side of a bag being completed and a seal at the leading side of the next bag to be formed, said apparatus having flap separating means extending from said bag forming means to the clamps, the flaps of a bag travelling on opposite sides of said separating means as the bag is fed forward to the loading station.

13. Packaging apparatus as set forth in claim 12 having means for forming notches in the center-folded web at bag width intervals along its open side, said lines of severance extending from the center fold side of the web to the notches, whereby the portions of the walls of each bag between the notches at its mouth end are free of one another all across the bag and at the corners of the bag to form said flaps.

14. Packaging apparatus as set forth in claim 12 wherein said bag forming means comprises means for intermittently feeding a bag width of the web generally horizontally through the severing and heat-sealing means and the bags are formed in a generally horizontal plane, and said bag feeding means comprises conveyor means for feeding forward a bag issuing from the bag forming means to the loading station in said plane, wherein the clamps extend generally horizontally at the loading station, one clamp constituting an upper clamp for clamping the flap of the upper wall of the bag and the other clamp constituting a lower clamp for clamping the flap of the lower wall of the bag, and wherein the loading means comprises means for pushing a unit to be packaged into the opened bag at the loading station.

15. Packaging apparatus as set forth in claim 14 having means for stopping said conveyor means with a bag at the loading station, with the mouth of the bag toward one side of said conveyor means, and with the flaps of the bag in the clamps, and wherein the loading means comprises means for pushing a unit to be packaged into the opened bag from said one side of the conveyor means.

16. Packaging apparatus as set forth in claim 15 having means extending alongside said conveyor means for feeding units to said loading station to be pushed into an opened bag by said pushing means.

17. Packaging apparatus as set forth in claim 16 wherein one jaw of each clamp constitutes an upper jaw of the clamp and the other constitutes a lower jaw of the clamp, the upper jaw of the lower clamp being fixed generally in said horizontal plane and the lower jaw of the lower clamp being movable upwardly toward the upper jaw of the lower clamp to clamp the lower flap, the upper clamp when in its flap-receiving position being located above and adjacent the upper jaw of the lower clamp and being movable upwardly away from the latter to open a bag, and wherein the unit is pushed by said pushing means off said unit feed means over the upper jaw of the lower clamp into the bag.

18. Packaging apparatus as set forth in claim 17 wherein the flap separating means has means at its end toward the clamps for guiding the upper flap of a bag upwardly between the open jaws of the upper clamp.

19. Packaging apparatus as set forth in claim 18 wherein the flap separating means has means at its end toward the clamps for guiding the lower flap of a bag downwardly between the open jaws of the lower clamp.

20. Packaging apparatus as set forth in claim 17 wherein the flap separating means has means at its end toward the clamps for guiding the upper flap of a bag upwardly between the open jaws of the upper clamp and the lower flap of the bag downwardly between the open jaws of the lower clamp.

21. Packaging apparatus as set forth in claim 17 wherein the flap separating means comprises a blade extending from upstream of the severing and heat-sealing means to a point adjacent the upstream end of the clamps.

22. Packaging apparatus as set forth in claim 15 having means for heat-sealing together the walls of the bag at the loading station adjacent the mouth end of the bag after the bag has been loaded.

23. Packaging apparatus as set forth in claim 22 wherein said means for heat-sealing together the walls of the bag comprises an upper and a lower seal bar movable relatively toward and away from one another and adapted to apply heat and pressure to the bag walls for heat-sealing them together.

24. Packaging apparatus as set forth in claim 23 further having means at the loading station for spreading horizontally flat the mouth end of the opened bag at the loading station preparatory to the heat-sealing of the bag.

* * * * *

UNITED STATES PATENT OFFICE

CERTIFICATE OF CORRECTION

Patent No. 3,952,480 Dated April 27, 1976

Inventor(s) John E. Nordstrom Page 1 of 2

It is certified that error appears in the above-identified patent and that said Letters Patent are hereby corrected as shown below:

Column 11, should appear as shown on the attached sheet.

Signed and Sealed this

Sixteenth Day of November 1976

[SEAL]

*Attest:*

RUTH C. MASON
*Attesting Officer*

C. MARSHALL DANN
*Commissioner of Patents and Trademarks* cable 387 interconnects the lower end of the lever with the slide 361 of the left-hand spreader unit 335*a*.

The profiles and phasing of the bag opener cam 177, the bag sealer cam 285 and the bag spreader cam 373 are shown in FIG. 34. Secured on the camshaft 179 along with these three cams is a cam 389 for actuating a switch LS15 for starting the programmer 391 illustrated in FIG. 35, as will appear. The cam 389 comprises a disk having a notch 393, the switch LS15 having an operating arm carrying a roller 395 adapted to drop into the notch for momentary actuation of the switch once each revolution of the cam 389.

Referring to FIGS. 13 and 14, the knife 13 is shown to be mounted on the bottom of a vertically movable beam 401 extending transversely across the apparatus above the back-up roll 14. Extending down from the beam at opposite ends thereof are slides 403 which are vertically slidable on stationary vertical guide rods 405. At 407 are indicated lower slides vertically slidable on rods 405 below the upper slides 403, these lower slides being connected one to the other by a yoke 409 and being connected to the upper slides via air cylinders 411. The yoke is movable up and down by an air cylinder 413 to raise and lower the lower slides 407, and via the air cylinders 411 to raise and lower the upper slides 403 and the beam 401 and knife 13. Air cylinder 413 operates the yoke via a parallelogram linkage 415. Air cylinders 411 interposed between the lower slides 407 and the upper slides 403 permit control of pressure of the knife 13 on the back-up roll 14, and are operable to back the knife off (upwardly) from the roll 14 when the apparatus stops, thereby to avoid burning of the roll 14, which typically has a rubber sleeve covered with "Teflon"-impregnated glass cloth. The feed rolls 61*a* and 61*b* (which may also be referred to as the draw rolls) of the bag side seal unit are adapted to be driven via a drive 417 including an electric clutch and brake unit 418 (see FIG. 36B) when the knife 13 is raised to feed forward a bag width increment of the center-folded web W between the knife 13 and the back-up roll 14. Air cylinders such as indicated at 419 bias the upper draw roll 61*a* down toward the lower draw roll 61*b* to grip the web W. Suitable gearing (not shown) interconnects the lower draw roll 61*b* and the back-up roll 14 to rotate the back-up roll on each cycle of operation of the draw rolls at a greater rate than the draw rolls so as to change the region of the back-up roll presented to the knife on successive cycles.

In the second bag conveyor 103, the upper reaches 103*a* of the endless belts 111 travel over a vacuum box 421 (see FIGS. 17 and 23). Each of these belts has a series of perforations 423 on its longitudinal center line which, in the upper reach of the belt, travels over a series of slots 425 in the top of the vacuum box. The latter is continuously evacuated by means of a suitable vacuum pump 427 (see FIG. 36A). Vacuum is applied to a bag on the upper reaches of the belts via the slots 425 in the top of the vacuum box and the holes 423 in the belts to grip the bag to the belts. Conveyor 103 is adapted to be driven via a drive indicated generally at 429 including an electric clutch and brake unit 431 (see FIG. 36B). The clutch is actuated and the brake is deactuated to start the conveyor somewhat before a bag is delivered to it by the first conveyor 101, and comes up to the same rate of speed as the conveyor 101 just before the bag is delivered to it by the first conveyor 101. Then it feeds the bag forward to the loading station 2 and stops with the bag in loading position